US012157999B2

(12) United States Patent
Stearns et al.

(10) Patent No.: US 12,157,999 B2
(45) Date of Patent: Dec. 3, 2024

(54) ICE AND SNOW RETENTION SYSTEM

(71) Applicant: Vermont Slate & Copper Services, Inc., Morrisville, VT (US)

(72) Inventors: Brian Cecil Stearns, Tucson, AZ (US); Kris Michaud, Milton, VT (US); Michael Robert Carter, Cambridge (CA)

(73) Assignee: Vermont Slate & Copper Services, Inc., Morrisville, VT (US)

( * ) Notice: Subject to any disclaimer, the term of this patent is extended or adjusted under 35 U.S.C. 154(b) by 0 days.

(21) Appl. No.: 17/531,559

(22) Filed: Nov. 19, 2021

(65) Prior Publication Data

US 2022/0136242 A1 May 5, 2022

Related U.S. Application Data

(63) Continuation of application No. 16/819,001, filed on Mar. 13, 2020, now Pat. No. 11,255,086.

(60) Provisional application No. 62/817,708, filed on Mar. 13, 2019.

(51) Int. Cl.

| | |
|---|---|
| ***E04B 1/346*** | (2006.01) |
| ***E04B 7/18*** | (2006.01) |
| ***E04D 13/04*** | (2006.01) |

(52) U.S. Cl.

CPC ..... *E04B 7/18* (2013.01); *E04D 13/0404* (2013.01)

(58) Field of Classification Search

CPC ..... E04B 7/18; E04D 13/0404; E04D 13/10
See application file for complete search history.

(56) References Cited

U.S. PATENT DOCUMENTS

| | | | | |
|---|---|---|---|---|
| 402,641 | A | 5/1889 | Wright | |
| 473,512 | A * | 4/1892 | Laird | E04D 13/10 52/25 |
| 939,516 | A * | 11/1909 | Laird | E04D 13/10 52/25 |
| 1,054,091 | A * | 2/1913 | Darnall | E04D 13/10 52/25 |
| 3,579,930 | A | 5/1971 | Murphy | |
| 4,005,557 | A * | 2/1977 | Kramer | E04H 9/14 52/24 |
| 5,983,588 | A * | 11/1999 | Haddock | E04G 21/3261 52/24 |
| 6,256,933 | B1 | 7/2001 | Kuhns | |

(Continued)

OTHER PUBLICATIONS

Office Action from the United States Patent and Trademark Office for U.S. Appl. No. 16/819,001 dated Mar. 10, 2021 (6 pages).

(Continued)

*Primary Examiner* — Basil S Katcheves
(74) *Attorney, Agent, or Firm* — KW Law, LLP

(57) ABSTRACT

A retention system may comprise a bracket, a bar system, a seal and a bonded washer. The bracket may have a first portion and a second portion. The first portion and the second portion may be operatively coupled together at an angle θ. The bracket may also have a texture. The bracket may define a mounting surface. The bar system may comprise a bar installable in the bracket. The seal may be installable in the bracket and disposed beneath the mounting surface. The bonded washer may be installable on and compressible against the mounting surface.

12 Claims, 26 Drawing Sheets

(56) References Cited

U.S. PATENT DOCUMENTS

| | | | | |
|---|---|---|---|---|
| 6,715,254 | B2 * | 4/2004 | Regular | E04D 13/12 52/24 |
| 7,997,032 | B2 * | 8/2011 | Riley | E04D 13/10 52/24 |
| 9,085,900 | B2 * | 7/2015 | Haddock | F16B 2/065 |
| 11,255,086 | B2 * | 2/2022 | Stearns | E06B 3/5454 |
| 2005/0102958 | A1 * | 5/2005 | Anderson | E04D 13/10 52/698 |
| 2005/0108952 | A1 * | 5/2005 | Trevorrow | E04D 13/10 52/25 |
| 2007/0245636 | A1 * | 10/2007 | Ayer | E04D 13/10 52/24 |
| 2018/0119425 | A1 * | 5/2018 | Kovacs | F24S 25/615 |

OTHER PUBLICATIONS

Notice of Allowance from the United States Patent and Trademark Office for U.S. Appl. No. 16/819,001 dated Aug. 26, 2021 (7 pages).

* cited by examiner

ICE AND SNOW RETENTION SYSTEM

CROSS REFERENCE TO RELATED APPLICATIONS

The present application is a continuation of U.S. Ser. No. 16/819,001, which is issued as U.S. Pat. No. 11,255,086, which claims priority to and the benefit of U.S. Provisional Patent Application Nos. 62/817,708, filed Mar. 13, 2019 and entitled ICE AND SNOW RETENTION SYSTEM, the entire contents of each are herein incorporated by reference for any purpose.

FIELD

The present disclosure relates to ice and/or snow retention system. More particularly, the present disclosure relates to ice and/or snow retention systems for high rise building ledges.

BACKGROUND

Highrise buildings in cold climates accumulate ice and snow. During windy conditions the accumulated ice may be pulled off the building by a vacuum effect created by the interaction between the windy condition and building surfaces. Where the ice and snow are pulled off in large pieces, they pose a safety risk to pedestrians and property on the ground below. As such, there is a need for a system to manage the release of snow and ice from building surfaces (e.g., ledges, facades, and/or the like).

SUMMARY

In various embodiments, a retention system may comprise a bracket, a bar system, a seal and a bonded washer. The bracket may have a first portion and a second portion. The first portion and the second portion may be operatively coupled together at an angle θ. The bracket may also have a texture. The bracket may define a mounting surface. The bar system may comprise a bar installable in the bracket. The seal may be installable in the bracket and disposed beneath the mounting surface. The bonded washer may be installable on and compressible against the mounting surface.

In various embodiments, the bar system may be removable from the bracket. The bar system may also be integrally formed with the bracket. The bar may be a one of a sideways v profile, a hub and spoke profile, a c channel profile, a triangular shaped profile, an I-beam profile, a plus sign profile, a box profile, or a pipe profile. The bar system may have a uniform geometric profile.

In various embodiments, the texture may be one of a saw tooth profile, a barbell profile, a t-standoff profile, a straight standoff profile, an L-stand-off profile, or serrations. The texture may be on an interior surface of the first portion and a top portion of the second portion. The bar system may also have a surface texture.

In various embodiments, the angle θ may be between 35° and 65°. The angle θ may also be between 35° and 55°. The angle θ may also be between 40° and 50°. The angle θ may be approximately 45°.

In various embodiments, the bracket may comprise a weep hole or a drain hole.

In various embodiments, a snow and ice retention assembly may comprise a bracket, a wire system, and a seal. The bracket may have a first portion and a second portion. The first portion and the second portion may be operatively coupled together at an angle θ. The second portion may define a mounting surface. The wire system may be installable on the bracket. The wire system may comprise a plurality of wire members defining a mesh. The seal may be installable in the second portion and disposed beneath the mounting surface.

In various embodiments, the mesh may define a flow area. The flow area may correspond to an open area defined configured to allow ice or snow to move through the mesh.

In various embodiments, the bracket may be mounted to a building structure with a tape. The bracket may comprise a texture. The texture may have a saw tooth profile, a barbell profile, a t-standoff profile, a straight standoff profile, a L-stand-off profile, or serrations. The bracket may further comprise a first retainer hook disposed on the first portion and a second retainer hook disposed on the second portion.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

In various embodiments, the ice retention systems disclosed herein may be configured to retain, manage, and/or otherwise hold snow and ice in place. More specifically, the system may be configured to retain snow and ice from sliding, falling or blowing off the roof, facade and windowsills or ledges of buildings. The system may be configured to manage ice and snow on buildings to encourage melting and/or "slow" disposition of snow and ice in small or liquid pieces.

In various embodiments and with reference to FIGS. 1A-1I, a snow and ice retention system 100 may comprise a bracket 110, and a bar system 130. Bar system 130 may comprise one or more bars 132. Bar system 130 may be configured to operatively couple to bracket 110. Moreover, bar system 130 may stand between the first bracket 110 and the second bracket 110. In this regard, bar system 130 may be supported by or held in place by bracket 110.

Figure 1A:
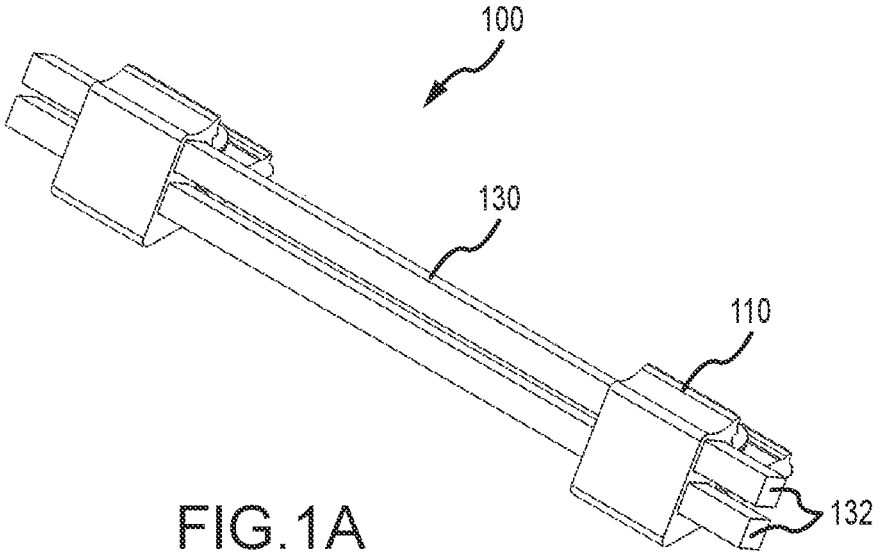
FIG. 1A illustrates a perspective view of a snow or ice retention system, in accordance with various embodiments.
Figure 1B:
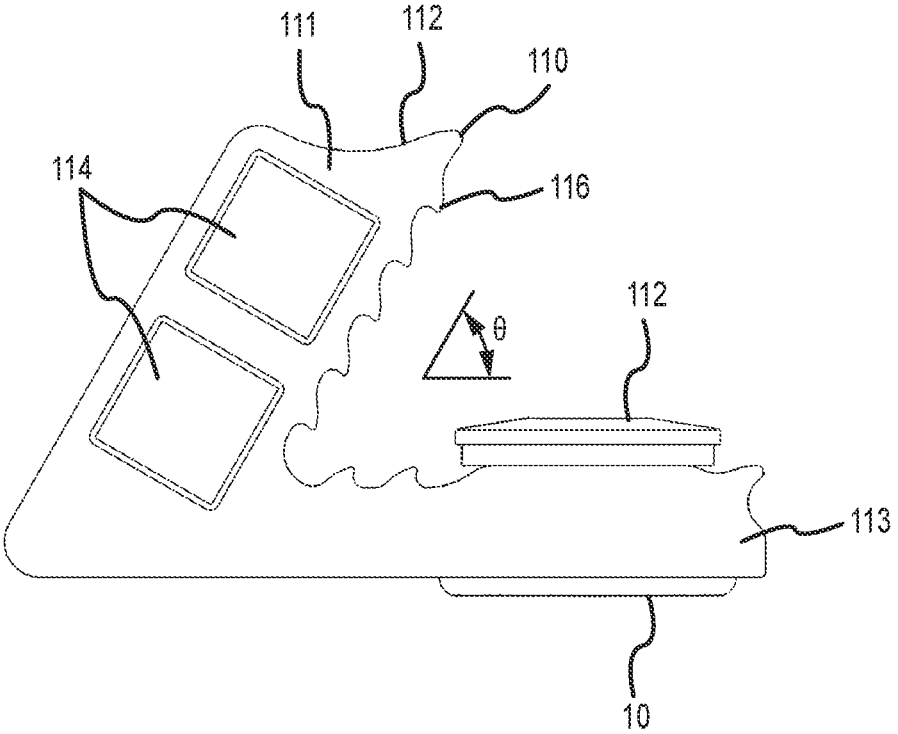
FIG. 1B illustrates a side view of a snow or ice retention bracket, in accordance with various embodiments.
Figure 1C:
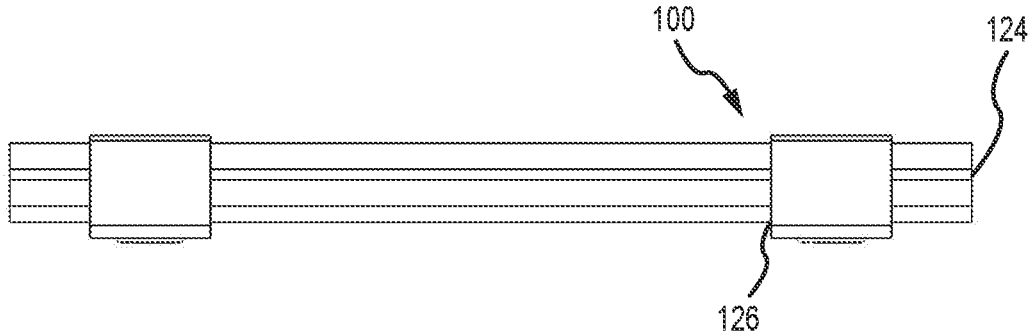
FIG. 1C illustrates a front view of a snow or ice retention system, in accordance with various embodiments.
Figure 1D:
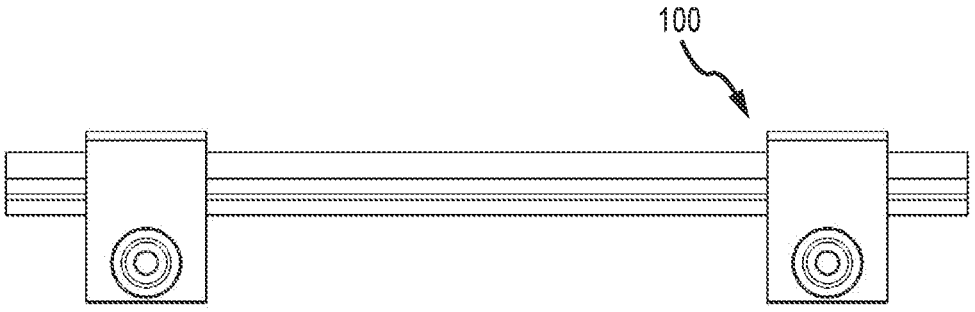
FIG. 1D illustrates a bottom view of a snow or ice retention system, in accordance with various embodiments.
Figure 1E:
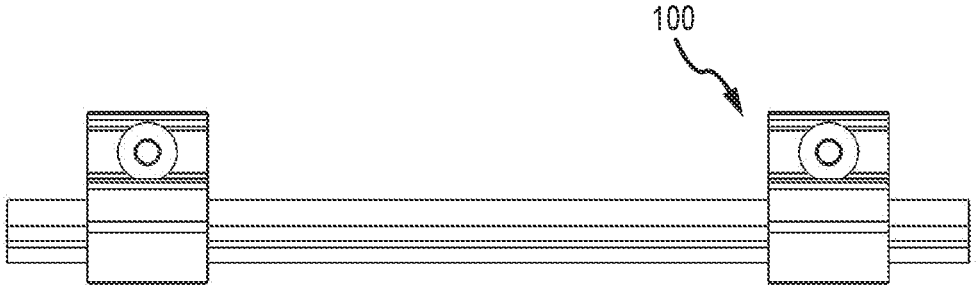
FIG. 1E illustrates a top view of a snow or ice retention system, in accordance with various embodiments.

In various embodiments, bracket 110 may comprise a body 112. Body 112 may comprise a first portion 111 and a second portion 113. First portion 111 and second portion 113 may be integrally formed with one another or may be an assembly. Moreover, first portion 111 and second portion 113 may be formed or oriented relative to one another such that they defined an angle θ, as shown in FIG. 1B. In some embodiments, bracket 110 may define an angle θ between 10° and 80°. In some embodiments, bracket 110 may define an angle θ between 35° and 65°. In some embodiments, bracket 110 may define an angle θ between 35° and 55°. In some embodiments, bracket 110 may define an angle θ between 40° and 50°. For example, bracket 110 may define an angle θ of approximately 45°.

In various embodiments, body 112 of bracket 110 may comprise one or more channels 114. Channel 114 may be defined through body 112. More specifically, channel 114 may be defined through first portion 111. Channel 114 may be shaped to receive one or more bars 132 of bar system 130. In practice, bracket 110 may comprise two or more channels 114, as shown in FIG. 1B. Channels 114 may be spaced apart from one another such that there is a gap 124 between each bar 132 of bar system 130 that is retained in bracket 110. Similarly, channels 114 may be disposed in the first portion 111 such that there is a gap between a building surface and a bottom surface of bar 132. These gaps may be intentionally defined such that they create a path for moisture (e.g., liquid water, or soft ice and snow) to slowly move from or off a building surface that is adjacent retention system 100.

In various embodiments, channel 114 may be defined in first portion 111 such that channel 114 and or bar 132 when installed in channel 114 is disposed at the angle θ. In this regard, the front face of bar 132 may be recessed from the front face of bracket 110, but the plane defined by the front face of bar 132 may be parallel to the plane defined by the front face of bracket 110.

In various embodiments, bracket 110 may comprise a texture 116. Texture 116 may be defined on any suitable surface of bracket 110. Texture 116 may be configured to increase the overall surface area or contact area of bracket 110. In this regard, texture 116 may be configured to create friction between bracket 110 and snow and ice accumulating on a building surface. Moreover, texture 116 may have any suitable profile. For example and as shown in FIG. 1B, texture 116 may be disposed on the upslope services of bracket 110. Moreover, texture 116 may have a sawtooth or wave profile.

In various embodiments, bracket 110 may be attachable to a building surface with a fastener. To facilitate mounting, bracket 110 may comprise a mounting surface 117 defined in second portion 113 of bracket 110. Bracket 110 may comprise an aperture or through hole 14 defined through second portion 113 and mounting surface 117. Through hole 14 may be defined in bracket 110 during manufacturing or it may be field formed during installation. Through hole 14 may have a counterbore profile, a countersink profile, a straight profile, and/or any other suitable profile. Through hole 14 may be configured to receive a fastener to facilitate attachment of bracket 110 to a building surface.

In various embodiments, mounting surface 117 may be a substantially flat surface or plane defined in bracket 110. This substantially flat surface or plane may help create a watertight connection to the building surface when bracket 110 is attached to the building surface by a fastener via through hole 14. During installation a seal 10 may be installed in through hole 14. Moreover, a washer 12 may be installed with the faster to attach bracket 110 to a building surface. Washer 12 may be a two-part seal or a bonded washer. The two-part seal may include a metal portion and a rubber portion. Moreover, washer 12 may be compressed against mounting surface 117 to seal the top opening of through hole 14. Moreover, seal 10 may be compressed by the faster and/or washer 12 such that a throat of seal 10 is compressed against and seals against the shaft of the fastener.

Figure 1F:
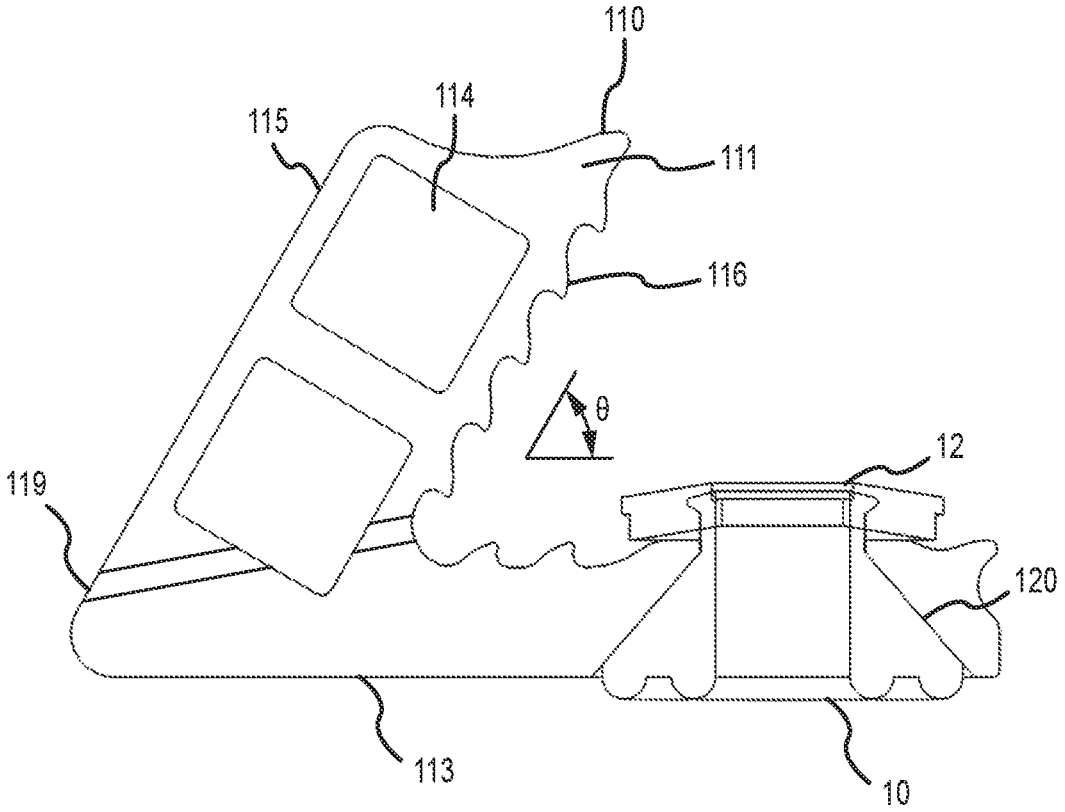
FIG. 1F illustrates a side view of a snow or ice retention bracket with secondary sealing system, in accordance with various embodiments.

In various embodiments and with particular reference to FIG. 1F, retention system 100 may include a secondary seal 118 disposed below bracket 110. In this regard, secondary seal 118 may be positioned on the underside of the second portion 113 or on the building surface where bracket 110 is to be mounted. Secondary seal 118 may be an elastomeric or adhesive seal such as, for example butyl tape. Secondary seal 118 may also be any other suitable seal or flashing including, for example, a metal, plastic, and/or the like.

Figure 1G:
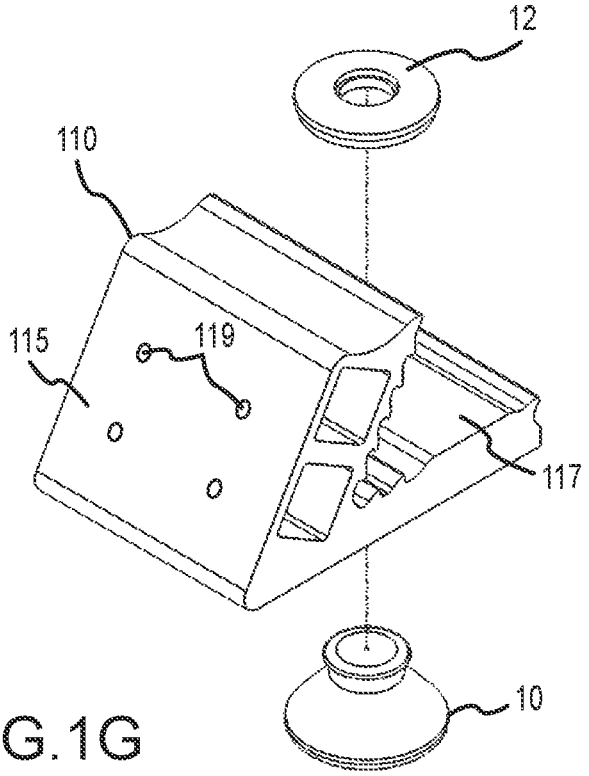
FIG. 1G illustrates a side, exploded, perspective view of a snow or ice retention bracket, in accordance with various embodiments.
Figure 1H:
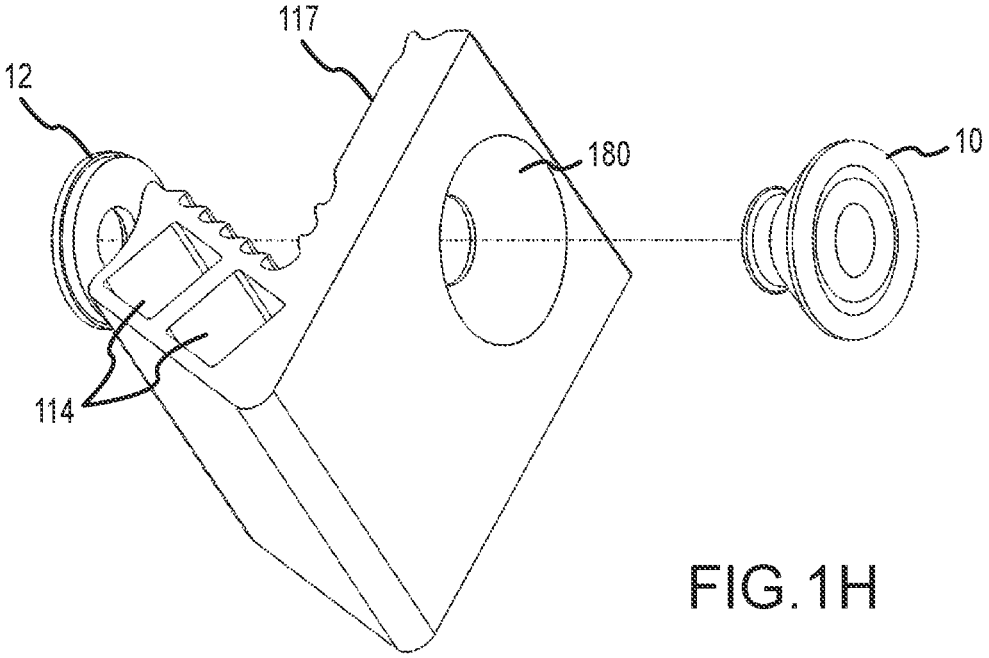
FIG. 1H illustrates a bottom, exploded, perspective view of a snow or ice retention bracket, in accordance with various embodiments.
Figure 1I:
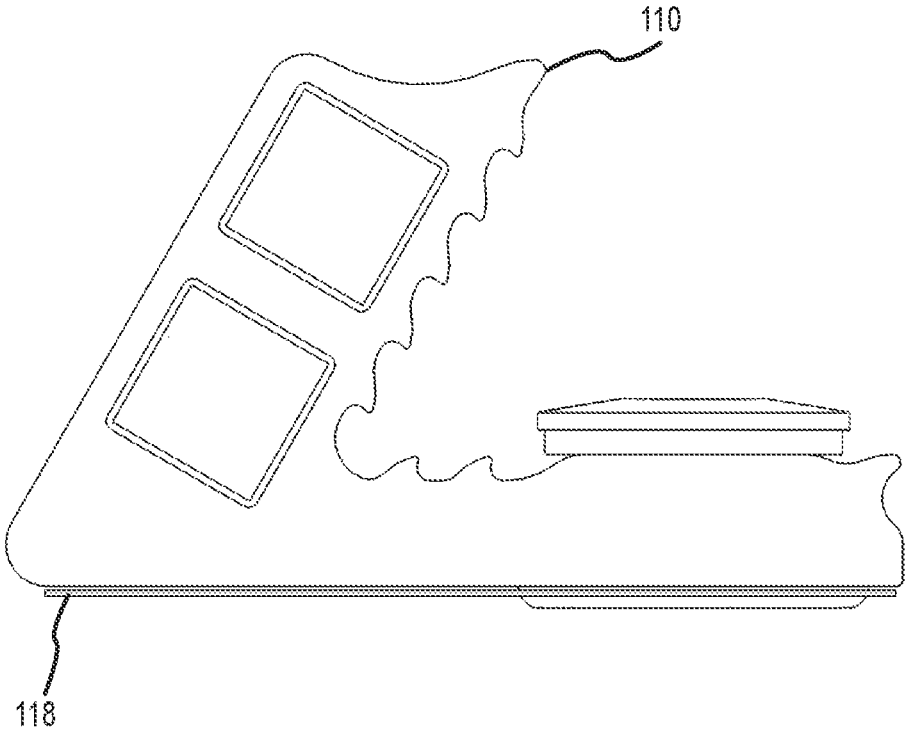
FIG. 1I illustrates a side cross-sectional view of a snow or ice retention bracket, in accordance with various embodiments.

In various embodiments and with particular reference to FIGS. 1G and 1H, bracket 110 may include one or more weep holes 119. Weep holes 119 may be defined through front surface 115 to facilitate the movement or wicking of moisture through bracket 110 and off of the building surface in a safe and slow manner.

In various embodiments and with reference to FIGS. 2A-2D, bracket 210 may be configured with various texture profiles. For example and with reference to FIG. 2A, bracket 210 may comprise texture 216A that has half dumbbell profile. Specifically, texture 216A may have a shaft that extends from a surface of bracket 210 that terminates in a ball or bulb.

Figure 2A:
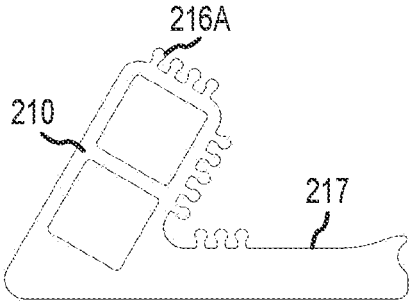
FIG. 2A illustrates a side view of a snow or ice retention bracket including a first texture, in accordance with various embodiments.
Figure 2B:
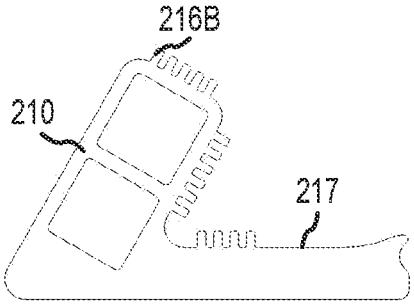
FIG. 2B illustrates a side view of a snow or ice retention bracket including a second texture, in accordance with various embodiments.

In other embodiments and with reference to FIG. 2B, texture 216B may be a plurality of uniform or nonuniform protrusions extending from bracket 210. In this regard, texture 216B may be a plurality of shafts extending from bracket 210.

Figure 2C:
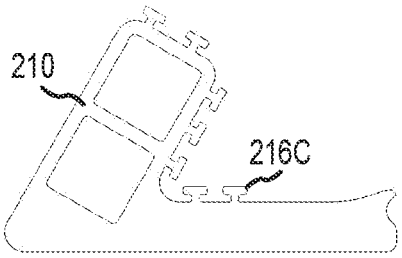
FIG. 2C illustrates a side view of a snow or ice retention bracket including a third texture, in accordance with various embodiments.

In other embodiments and with reference to FIG. 2C, texture 216C may have a "T" profile. In this regard, texture 216C may comprise a plurality of shafts with proximal ends extending from bracket 210. Each shaft may terminate at a crossmember on the distal end of the shaft, forming an "T" profile. The shaft may be substantially perpendicular to the crossmember.

Figure 2D:
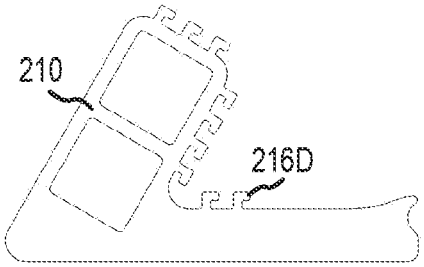
FIG. 2D illustrates a side view of a snow or ice retention bracket including a fourth texture, in accordance with various embodiments.

In other embodiments and with reference to FIG. 2D, texture 216D may have an "L" profile. In this regard texture 216D may comprise a plurality of shafts with proximal ends extending from bracket 210. Each shaft may terminate at a crossmember on the distal end of the shaft, forming an "L" profile. The shaft may be substantially perpendicular to the crossmember.

In various embodiments and with reference to FIGS. 3A-3H, bar system 330 may comprise one or more bars of any suitable profile. In this regard, the profile of a bar of bar system 330 may be formed or defined to create friction and/or engage snow and ice that accumulates on building surfaces. Moreover, the profiles of the bars of bar system 330 may be extruded from plastic or metal. As such the profiles may have a uniform longitudinal geometry to make extrusion manufacturing efficient and economical.

Figure 3A:
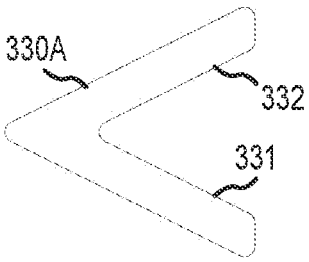
FIG. 3A illustrates a side profile view of a snow or ice retention bar with a sideway "V" profile, in accordance with various embodiments.

In some embodiments and with reference to FIG. 3A, one or more bars of bar system 330A may have a sideways "V" profile. Bar system 330A may comprise a bar having a first member 331 and a second member 332. First member 331 and second member 332 may be operatively coupled to one another. Moreover, first member 331 and second member 332 may be disposed at an angle such that they form a sideways "V."

Figure 3B:
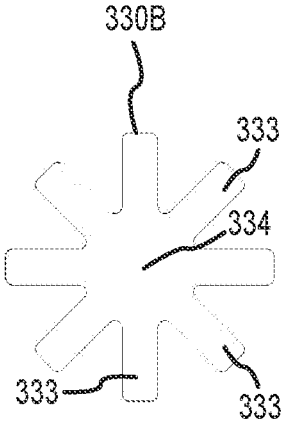
FIG. 3B illustrates a side profile view of a snow or ice retention bar with a hub and spoke profile, in accordance with various embodiments.

In other embodiments and with reference to FIG. 3B, one or more bars of bar system 330B may have a hub and spoke profile. In this regard, bar system 330B may comprise a hub 334 and a plurality of spokes 333 disposed about hub 334. Each spoke 333 may comprise a body portion having a proximal end and a distal end. The proximal and may be operatively coupled to or originate from hub 334. Each spoke 333 may extend radially away from hub 334 and terminate at its distal end space away from hub 334. The plurality of spokes 333 may be uniformly or nonuniformly disposed about hub 334. Moreover, each pair of spokes may define a channel or cavity that is configured to engage or catch ice and snow. In this regard, the channels defined between each pair of spokes creates additional surface area to engage ice or snow.

Figure 3C:
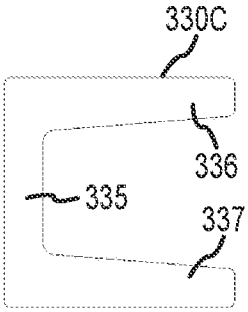
FIG. 3C illustrates a side profile view of a snow or ice retention bar with a "C" channel profile, in accordance with various embodiments.

In some embodiments and with reference to FIG. 3C, one or more bars of bar system 330C may have a "C" channel profile. In this regard, bar system 330C may comprise a first channel member 335, a second channel member 336, and third channel member 337. Second channel member 336 and third channel member 337 may be substantially parallel to one another. First channel member 335 may be substantially perpendicular to second channel member 336 and third channel member 337. First channel member 335 may comprise a first end and a second end. Second channel member 336 may comprise a proximal end and a distal end. First channel member 335 may be operatively coupled to second channel member 336 at the first end of first channel member 335 and the proximal and of second channel member 336. Moreover, first channel member 335 may be operatively coupled to third channel member 337 as the second and of first channel member 335 and the proximal and of third channel member 337. Second channel member 336 and third channel number 3037 may protrude from first channel member 335 in a substantially perpendicular fashion terminating at the distal end of second channel member 336 and the distal end of third channel member 337. Moreover, bar system 330C may define a channel defined by the interior portions of first channel member 335, second channel member 336, and third channel member 337. The defined channel may be configured to capture and/or create additional surface area for snow and ice to interact or engage with to slow the progression of snow and ice off of a building surface.

Figure 3D:
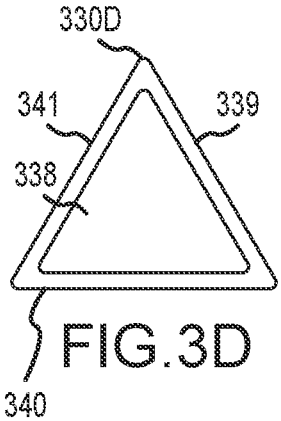
FIG. 3D illustrates a side profile view of a snow or ice retention bar with a triangular profile, in accordance with various embodiments.

In some embodiments and with reference to FIG. 3D, one or more bar systems 330D may have a triangular profile. In this regard, bar system 330D may comprise a first member 339, a second member 340, and a third member 341 operatively coupled together in a triangular profile defining a central channel 338. Bar system 330D may define a plurality of engagement surfaces for snow and ice to engage and/or adhere to, to slow the progression of snow and/or ice off of a building surface. Moreover, channel 338 may be configured to receive a resistive heating wire 399 that is configured to conduct energy and/or to one or more bar systems 330D to facilitate removal of snow and/or ice from a building surface.

Figure 3E:
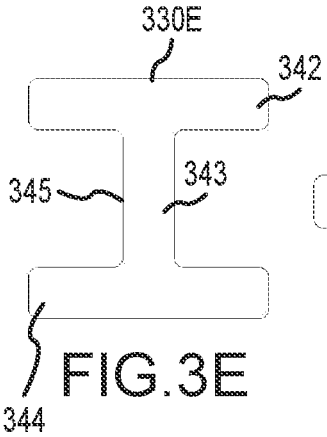
FIG. 3E illustrates a side profile view of a snow or ice retention bar with an I-beam profile, in accordance with various embodiments.

In other embodiments and with reference to FIG. 3E, one or more bar systems 330E may have a and "I" beam profile. Bar system 330E may comprise a central portion 343, a top portion 342, and a bottom portion 344. Central portion 343 may comprise a first end and a second end. Top portion 342 and bottom portion 344 may be substantially parallel to one another and operatively coupled to the first end and the second and of central portion 343 at the midpoint of top portion 342 and bottom portion 344, respectively. Bar system 330E may further comprise or define one or more channels 352 on opposing sides of central portion 343. In this regard, the one or more channels 352 may be configured to capture, engage, create friction, and/or adhere snow and/or ice to slow the progression of snow and ice off of the building surface.

Figure 3F:
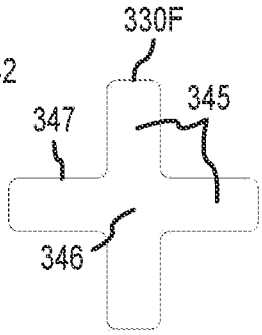
FIG. 3F illustrates a side profile view of a snow or ice retention bar with a plus sign profile, in accordance with various embodiments.

In yet other embodiments and with reference to FIG. 3F, one or more bar systems 330F may have a plus sign profile. Bar system 330F may comprise a horizontal member 345 and a vertical member 346. Horizontal member 345 and vertical member 346 may be operatively coupled or integrally formed together in a substantially perpendicular fashion at the respective midpoints of horizontal member 345 and vertical member 346. In this regard, bar system 330F may define four quadrants 347. Each of the quadrants 347 may be configured to capture, adhere, retain, create additional surface area, and/or otherwise engage snow and/or ice to slow the progression of snow and ice off of the building surface.

Figure 3G:
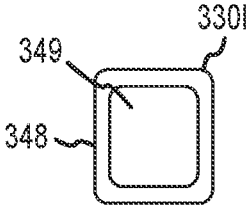
FIG. 3G illustrates a side profile view of a snow or ice retention bar with a box profile, in accordance with various embodiments.

In still other embodiments and with reference to FIG. 3G, one or more bar systems 330G may have a box profile. Bar system 330G may comprise four side members 348 arranged in a square or rectangular profile. For side members 348 may define a central void or channel 349. Each of the side members may be configured to capture, adhere, retain, create surface area, and/or otherwise engage snow and/or ice to slow the progression of snow and ice off of the building surface. Moreover, channel 349 may be configured to receive a resistive heating wire 399 that is configured to conduct energy and or heat to the one or more bar systems 330G to facilitate removal of snow and/or ice from a building surface.

Figure 3H:
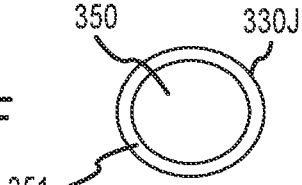
FIG. 3H illustrates a side profile view of a snow or ice retention bar with a pipe profile, in accordance with various embodiments.

In other embodiments and with reference to FIG. 3H, one or more bar systems 330H may have a pipe profile. Bar system 330H may comprise a circular or oval member 351 defining the circular or oval profile and a void or channel 350. Circular member 351 may be configured to capture, adhere, retain, create surface area, and/or otherwise engage snow and/or ice slow the progression of snow and ice off of the building surface. Moreover, channel 350 may be configured to receive a resistive heating wire 399 that is configured to conduct energy and/or to one or more bar systems 330H to facilitate removal of snow and/or ice from a building surface.

Figure 4:
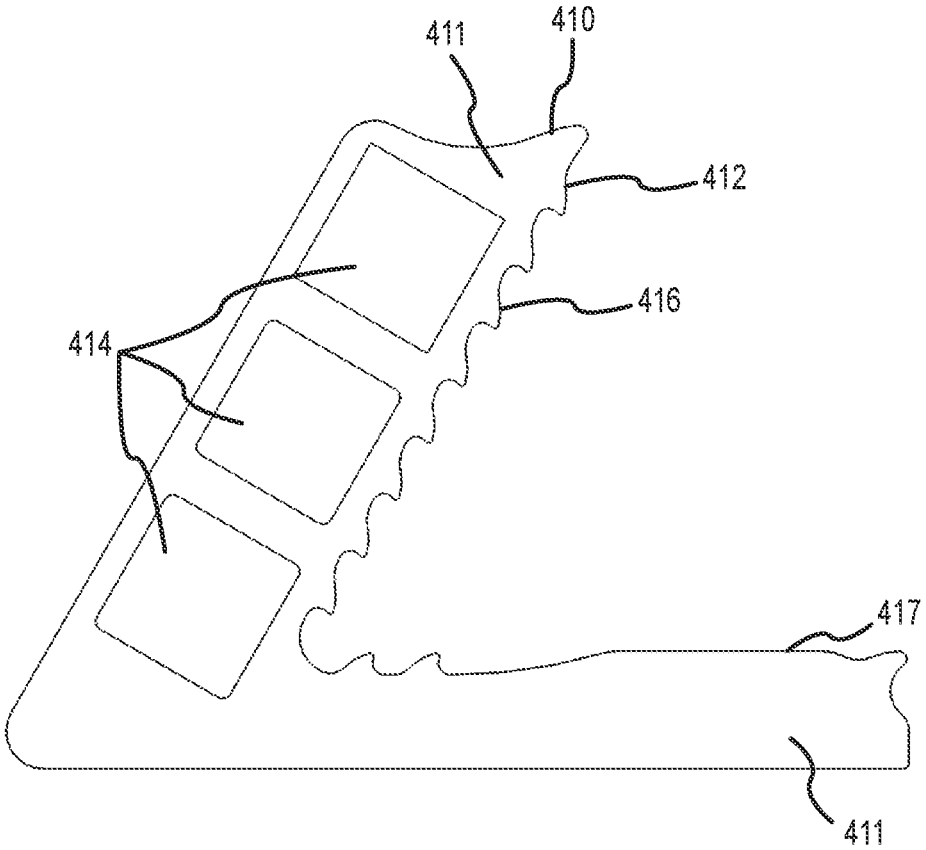
FIG. 4 illustrates a side view of a snow or ice retention bracket, in accordance with various embodiments.
Figure 5A:
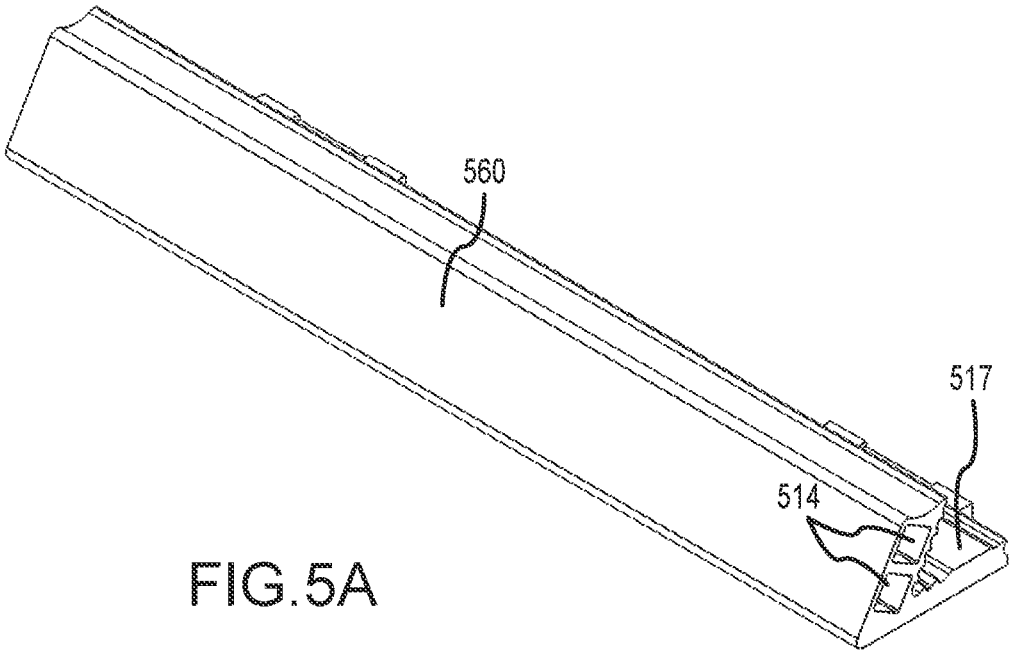
FIG. 5A illustrates a perspective view of a snow or ice retention system, in accordance with various embodiments.
Figure 5B:
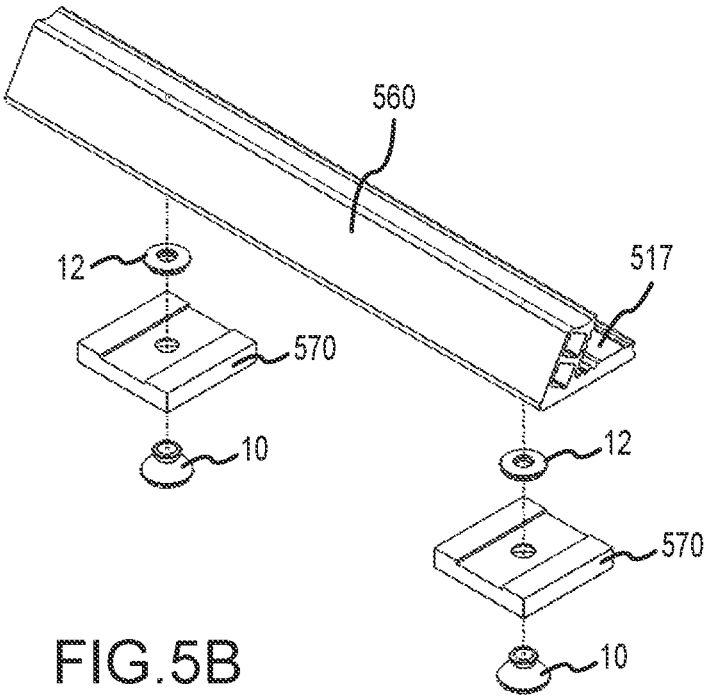
FIG. 5B illustrates an exploded perspective view of a snow or ice retention system, in accordance with various embodiments.
Figure 5C:
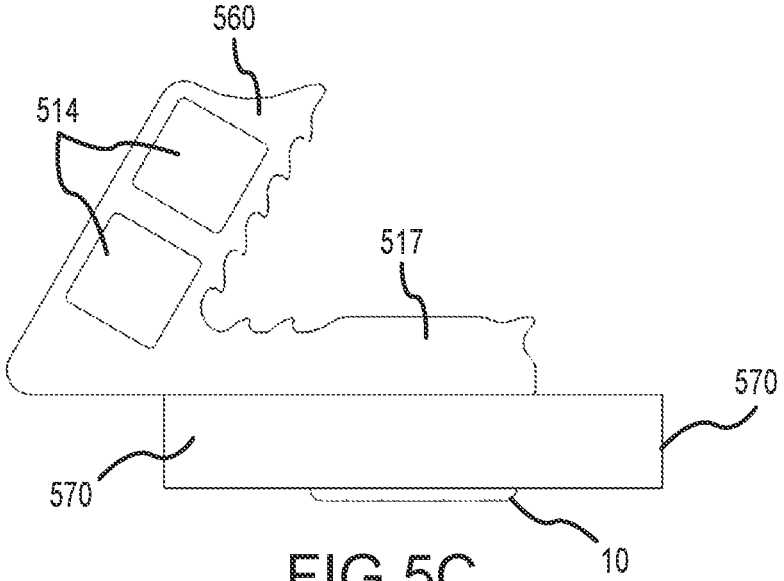
FIG. 5C illustrates a side view of a snow or ice retention system, in accordance with various embodiments.
Figure 5D:
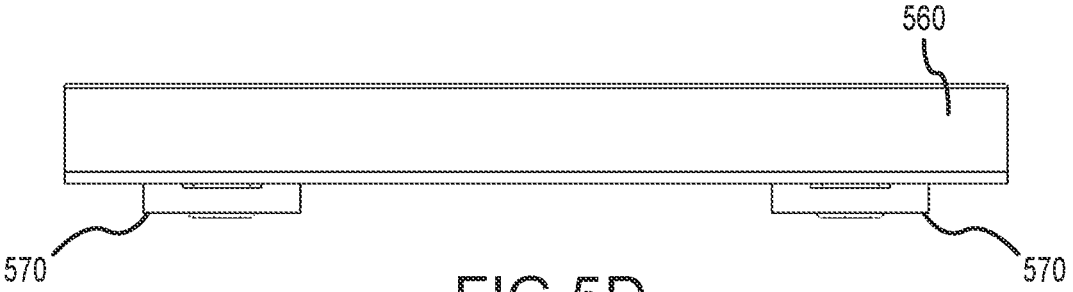
FIG. 5D illustrates a front view of a snow or ice retention system, in accordance with various embodiments.
Figure 5E:
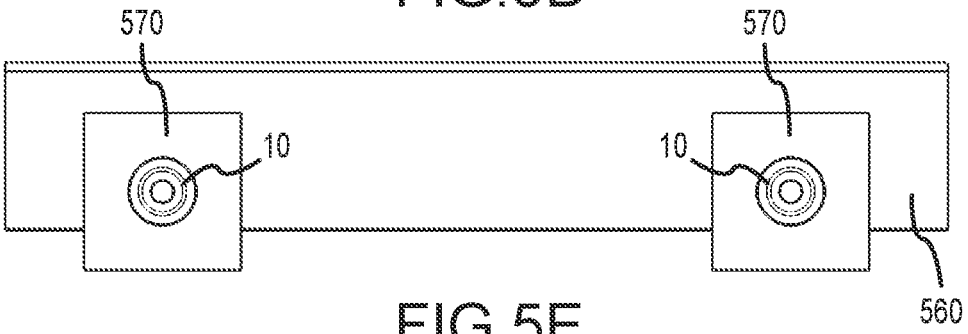
FIG. 5E illustrates a bottom view of a snow or ice retention system, in accordance with various embodiments.
Figure 5F:
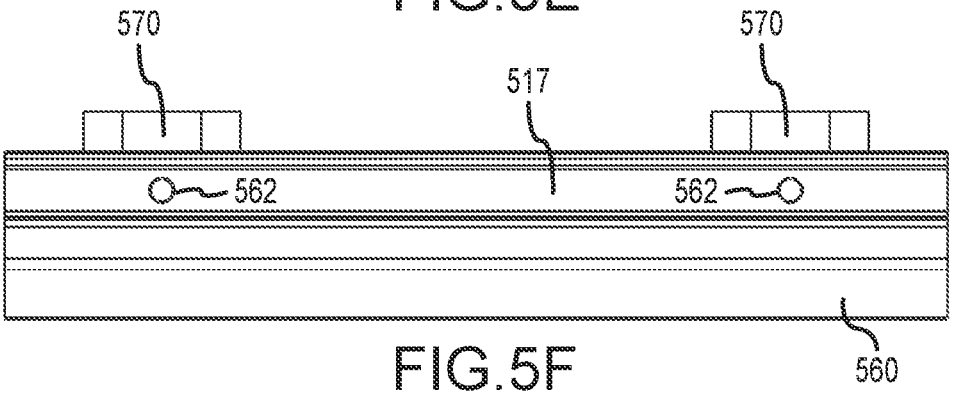
FIG. 5F illustrates a top view of a snow or ice retention system, in accordance with various embodiments.
Figure 5G:
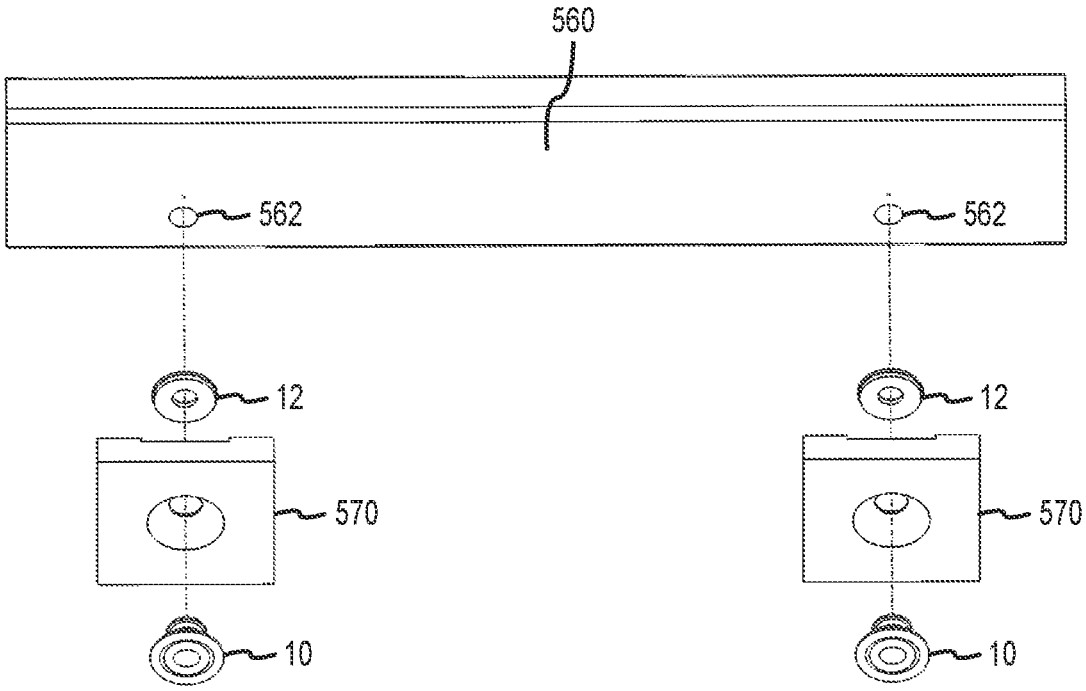
FIG. 5G illustrates an exploded bottom view of a snow or ice retention system, in accordance with various embodiments.
Figure 5H:
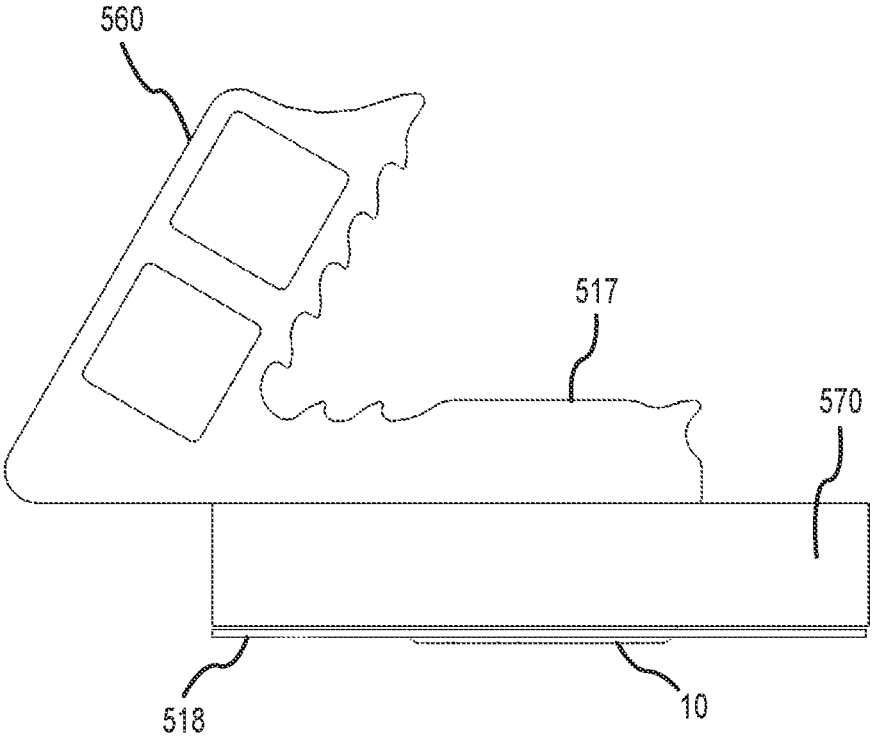
FIG. 5H illustrates a side view of a snow or ice retention system with a secondary sealing system, in accordance with various embodiments.

In various embodiments and with reference to FIG. 4, retention system 400 may comprise bracket 410 that comprises a plurality of channels 414 that are configured to receive a bar system. In this regard, while to channel systems and three channel systems are shown, one of ordinary skill in the art will appreciate that any number of channels may be formed in bracket 410 in light of the present disclosure. Moreover, bracket 410 and/or bracket body 412 may comprise any of the other features described herein such as mounting service 417, texture 416, and/or the like. Further, one of skill in the art will appreciate that any of the brackets described in the present disclosure, any of the textures described in the present disclosure, any of the bar systems described in the pledge present disclosure, and or any other sealing features, and/or the like may be used interchangeably with any other bracket, bar system, sealing system, and/or structure described herein.

In various embodiments and with reference to FIGS. 5A-5H, retention system 500 may comprise a retention section 560. Retention section 560 may be configured to directly mount to a building surface or may be mountable to a building surface with a mounting adapter 570. Retention section 560 may include a first portion 562 operatively coupled or integrally formed with a second portion 564. First portion 562 and second portion 564 may be joined together at an angle θ as described in detail herein. To facilitate manufacturing and the efficient and economical distribution of retention system 500, first portion 562 and second portion 564 may be formed by extrusion manufacturing, such that the features of first portion 562 and second portion 564 are formed during the manufacturing process. Moreover, retention system 500 may be mounted to a building surface via through hole 14 as discussed herein. In this regard, through hole 14 may be formed in first portion 562 during the manufacturing process or may be field formed during installation of retention system 500.

In various embodiments, retention section 560 may be operatively coupled to a building façade or surface with mounting adapter 570. Mounting adapter 570 may act as an interface between retention section 560 and the building surface. In this regard, mounting adapter 570 may be configured with through holes, a seal 10, a washer 12 and other suitable structures to facilitate a watertight connection between retention section 560 and the building surface. In this regard, mounting adapter 570 may include a through hole, a counterbore, a countersink, or any other suitable aperture and or seal profile to accommodate a watertight connection between retention section 560 and the building surface.

In various embodiments, mounting adapter 570 may be configured to accommodate a secondary seal 518. As discussed herein, retention section 560 may be mounted to a building surface where a watertight connection is necessary to maintain building integrity. Retention system 500 may be adapted to have a double interface with the building surface making use of secondary seal 518 as a flashing, elastomeric member, and/or the like as discussed herein.

Figure 6A:
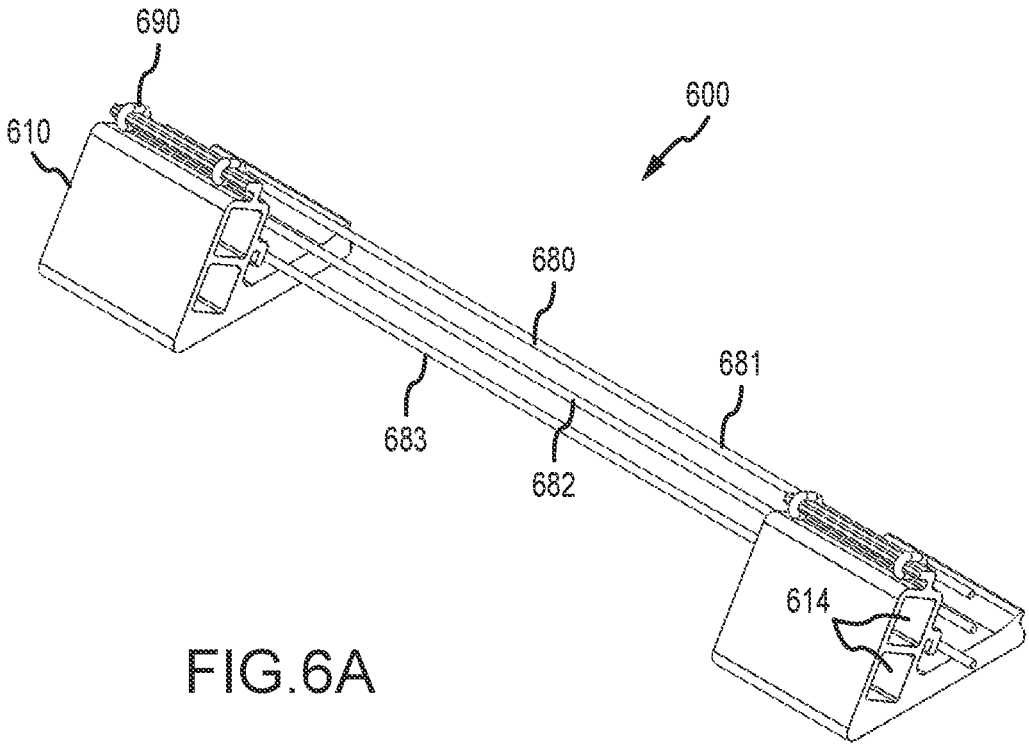
FIG. 6A illustrates a front perspective view of a snow or ice retention system, in accordance with various embodiments.
Figure 6B:
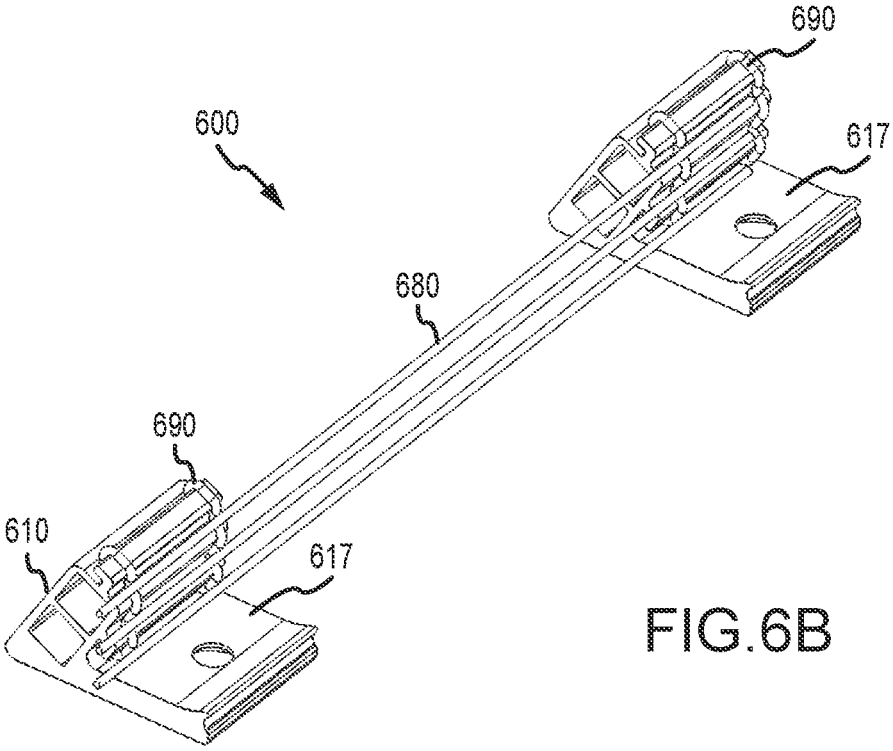
FIG. 6B illustrates a back-perspective view of a snow or ice retention system, in accordance with various embodiments.
Figure 6C:
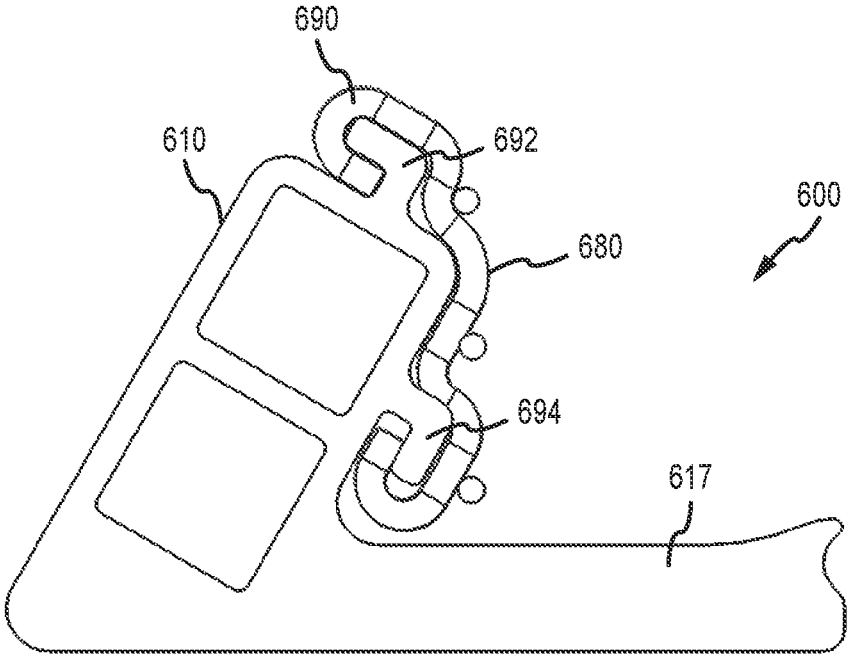
FIG. 6C illustrates a side view of a snow or ice retention system, in accordance with various embodiments.
Figure 7A:
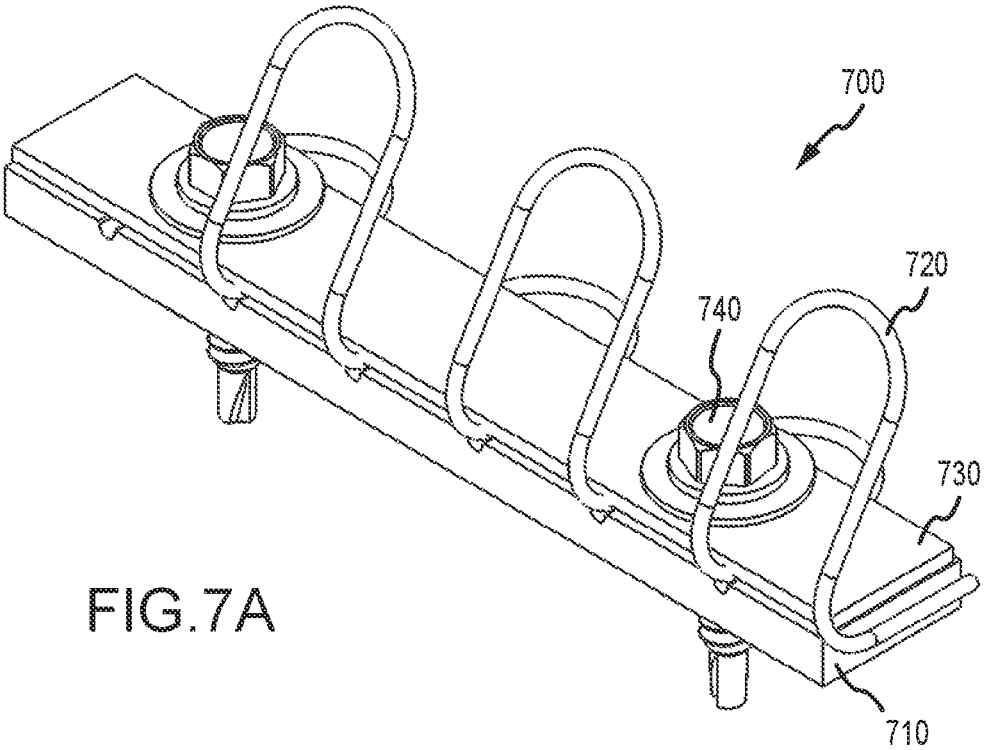
FIG. 7A illustrates a front perspective view of a snow or ice retention system, in accordance with various embodiments.
Figure 7B:
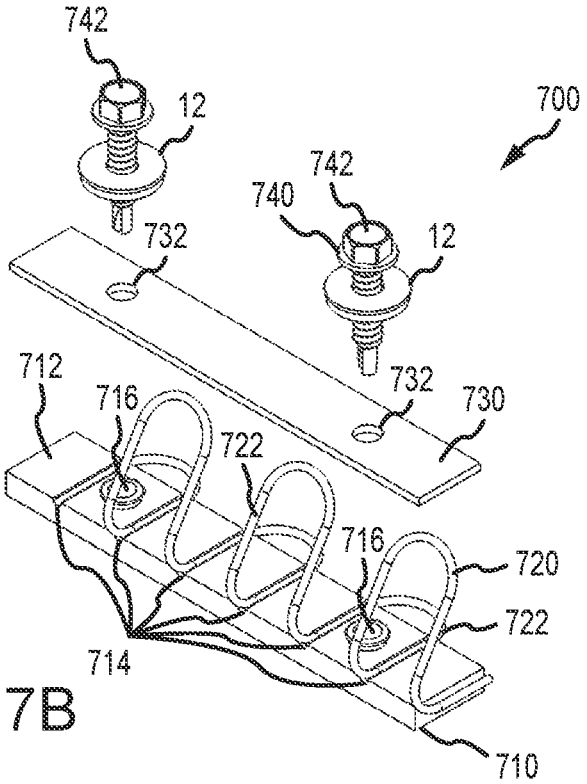
FIG. 7B illustrates an exploded, front perspective view of a snow or ice retention system, in accordance with various embodiments.
Figure 7C:
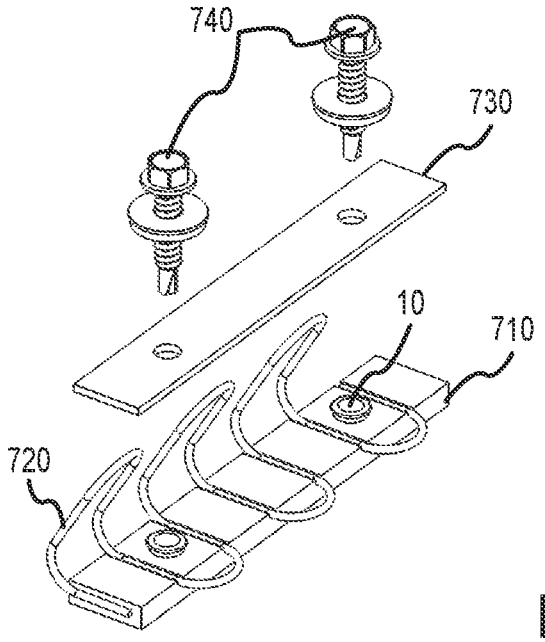
FIG. 7C illustrates an exploded, back perspective view of a snow or ice retention system, in accordance with various embodiments.
Figure 7D:
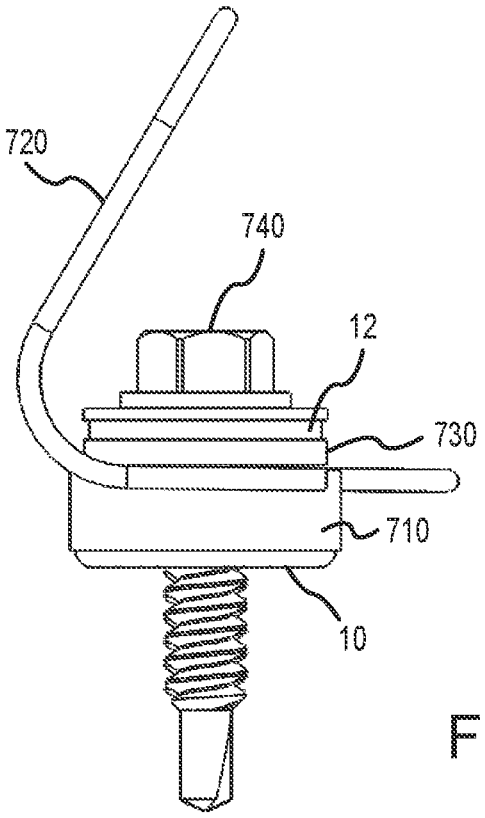
FIG. 7D illustrates a side view of a snow or ice retention system, in accordance with various embodiments.

In various embodiments and with reference to FIGS. 6A-6C, retention system 600 may comprise a bracket 610 adapted to engage a wire system 680. Bracket 610 may comprise a retainer 690. Wire system 680 may mount to bracket 610 at retainer 690. More specifically, retainer 690 may include a first hook 692 and a second hook 694. First hook 692 may be disposed on first portion 611 of bracket 610. First hook 692 may be positioned on a top portion or distal end of first portion 611 of bracket 610. Second hook 694 may also be disposed on a first portion 611 of bracket 610 or a second portion 613 of bracket 610. Second hook 694 may be positioned on a back portion of first portion 611 of bracket 610. Second hook 694 may also be positioned on a top portion of second portion 613 of bracket 610.

In various embodiments, first hook 692 may be any suitable structure configured to engage and retain wire system 680. Similarly, second hook 694 may be any suitable structure configured to engage and retain wire system 680. For example, first hook 692 and/or second hook 694 may have an "L" profile, a "T" profile, or any other suitable profile to engage in and retain wire system 680.

In various embodiments, wire system 680 may comprise one or more members such as, for example, member 681, member 682, member 683, and/or the like. The members of wire system 680 may have any suitable profile and may be any suitable length. Moreover, the members of wire system 680 may also be the bars of the bar systems described herein. Wire system 680 may also comprise one or more clips 684. Clip 684 may be operatively coupled to the one or more members. Clip 684 may also be configured to engage bracket 610 at retainer 690. More specifically, clip 684 may be adapted to engage first hook 692 or second hook 694 of retainer 690. In this regard, clip 684 may slide over or be snap fit onto first hook 692 and/or second hook 694 of retainer 690.

In various embodiments and with reference to FIGS. 7A-7D, retention system 700 may comprise a base 710, a wire system 720, and the retainer plate 730. Retention system 700 may be attached to a building surface with one or more fasteners 740. Wire system 720 may be retained between base 710 and retainer plate 730. Wire system 720 may be held in place and may create a barrier to slow the progression of snow and/or ice off of the building surface. In this regard, wire system 720 may comprise or be formed to include one or more wire loops 722. Wire loops 722 may protrude above base 710 and retainer plate 730, to create engagement structure to slow the progression of snow and/or ice off of the building surface.

In various embodiments, base 710 may comprise one or more channels 714. The one or more channels 714 may be uniformly distributed laterally across base 710. The one or more channels 714 may be sized to receive portions or loops 724 of wire system 720. Base 710 may also comprise one or more mounting holes or apertures 716. Mounting holes or apertures 716 may be defined during the manufacturing process or may be field formed.

In various embodiments, retainer plate 730 may comprise one or more mounting holes or apertures 732. Mounting holes or apertures 732 may be defined during the manufacturing process or may be field formed. Mounting holes 732 of retainer plate 730 may be alignable with mounting holes 716 of base 710. Fasteners 740 may be installable through mounting holes 732 of retainer plate 730 and mounting hole 716 of base 710 to secure retention system 700 to the building surface. Fasteners 740 may be configured with a washer 12 as described herein. Base 710 may be configured with a counterbore, countersink, or through hole that is adapted to receive a seal 10 as described herein.

Figure 8A:
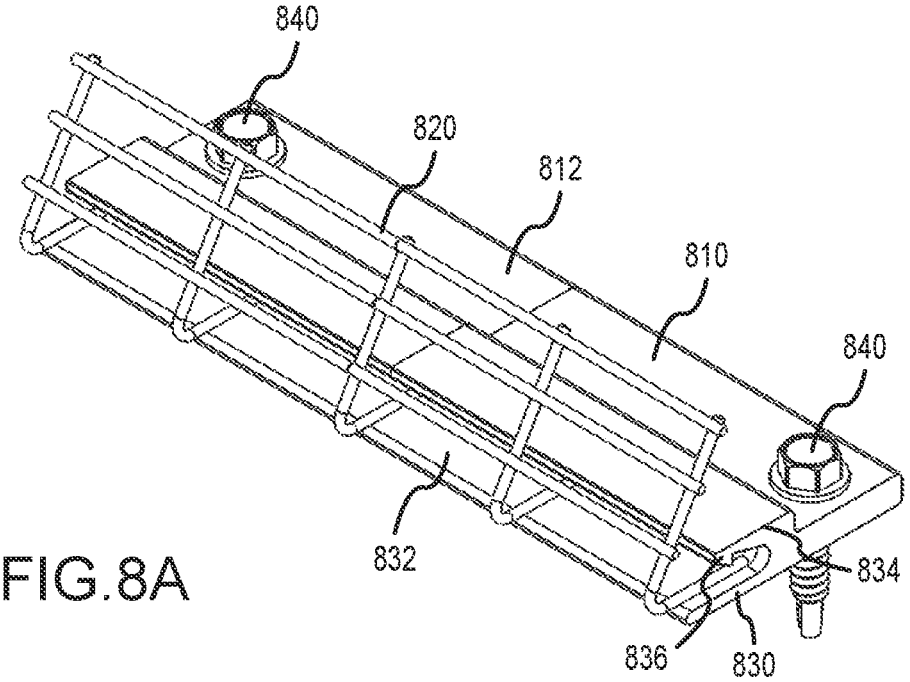
FIG. 8A illustrates a front perspective view of a snow or ice retention system, in accordance with various embodiments.
Figure 8B:
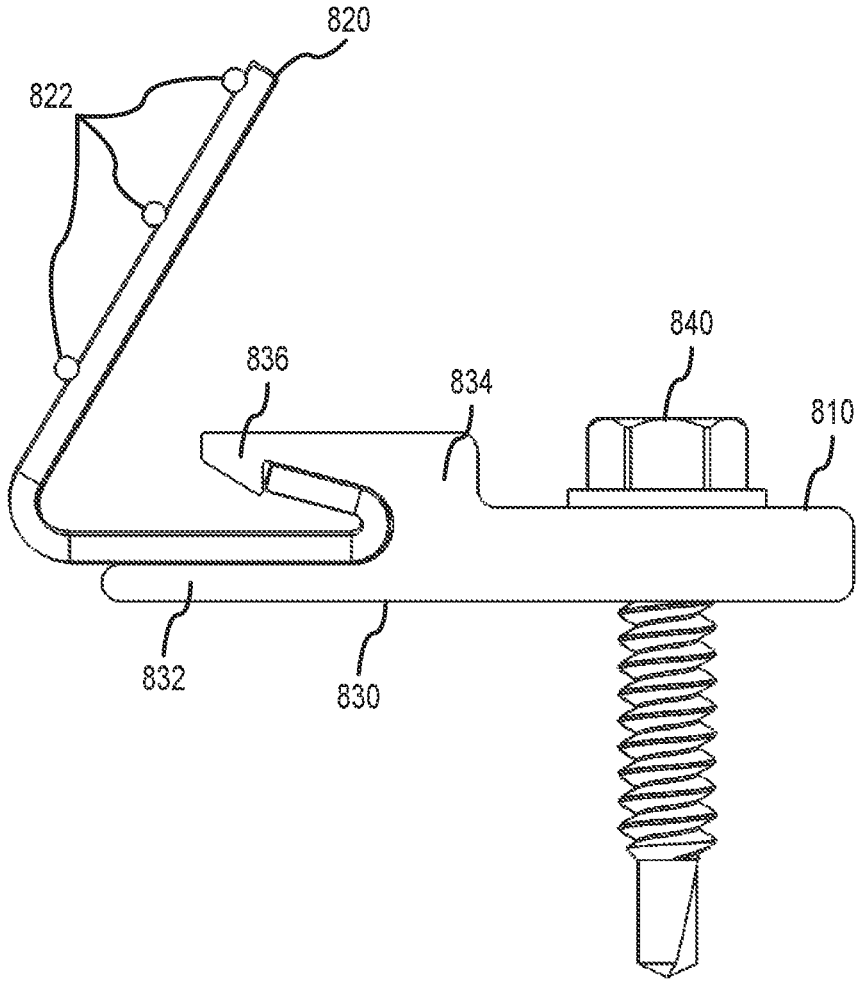
FIG. 8B illustrates a side view of a snow or ice retention system, in accordance with various embodiments.

In various embodiments and with reference to FIGS. 8A-8B, retention system 800 may comprise a base 810, a wire system 820, and a retention channel 830. Retention channel 830 may be defined in base 810. Retention channel 830 may be configured to engage one or more portions of wire system 820. In this regard, retention channel 830 may retain wire system 820 on base 810.

In various embodiments, wire system 820 may comprise one or more wire members 822, a wire hook standoff 824, and a wire hook base 826. The one or more wire members 822 may be operatively coupled to wire hook standoff 824. Wire hook base 826 and wire hook standoff 824 may be an assembly or maybe integrally formed with one another. Wire hook base 826 and wire hook standoff 824 may also be disposed at an angle θ as discussed herein.

In various embodiments, wire hook base 826 may be installable in retention channel 830 of base 810. More specifically, retention channel may include a retention jaw 832, a retention mouth 834, and a tooth 836. Wire hook base 826 may terminate in a hook. Wire hook base a 26 may be installed in retention mouth 834 and pressed or snapped into place such that the hook of wire hook base 826 engages tooth 836 and is positively retained in retention mouth 834.

In various embodiments and with reference to FIGS. 9A-9D, the wire and bar systems described herein may leverage various snow and ice retention structures 920. For example and with specific reference to FIG. 9A, screen 920A may be deployed with the various brackets and retention systems described herein. In other embodiments and with specific reference to FIG. 9B, mesh 920B may be deployed with the various bracket and retention systems described herein. In yet other embodiments and with specific reference to FIG. 9C, twisted rod 920C may be deployed with the various bracket and retention systems described herein. In other embodiments and with specific reference to FIG. 9D, a bent rod 920D having a box profile may be deployed with the various bracket and retention systems described herein. Each of the structures shown in the above referenced figures may be configured to increase the overall surface area of the retention system to facilitate the slow progression of ice and snow off of the building surface.

Figure 9A:
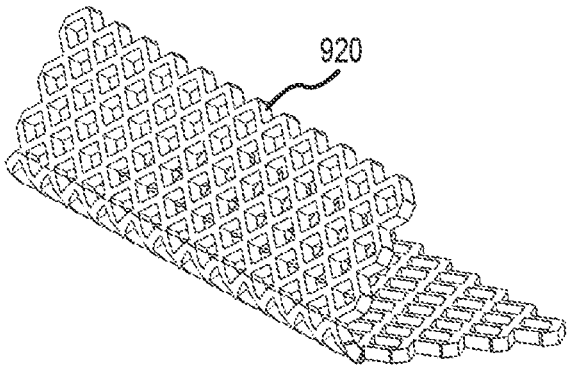
FIG. 9A illustrates a perspective view of a snow or ice screen, in accordance with various embodiments.
Figure 9B:
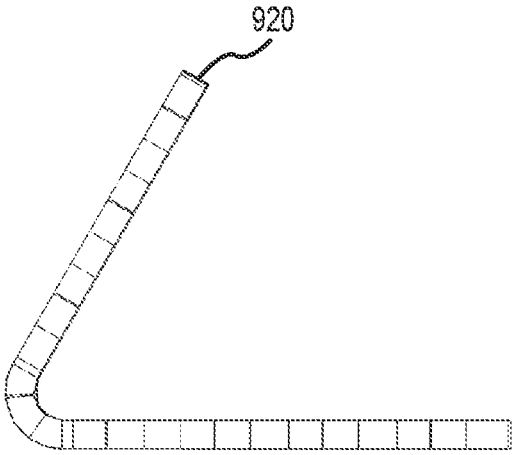
FIG. 9B illustrates a side view of a snow or ice mesh, in accordance with various embodiments.
Figure 9C:
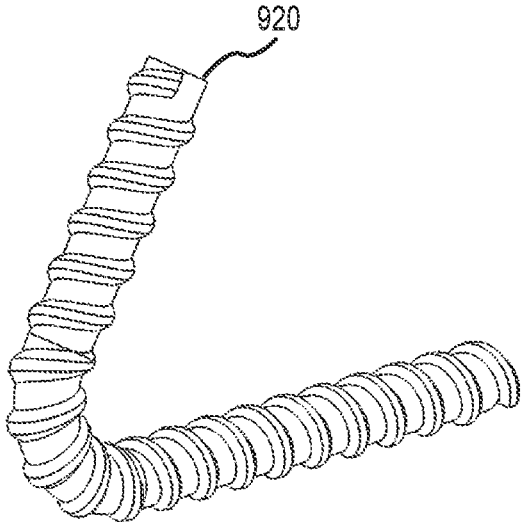
FIG. 9C illustrates a perspective view of a twisted rod for use with a snow or ice retention system, in accordance with various embodiments.
Figure 9D:
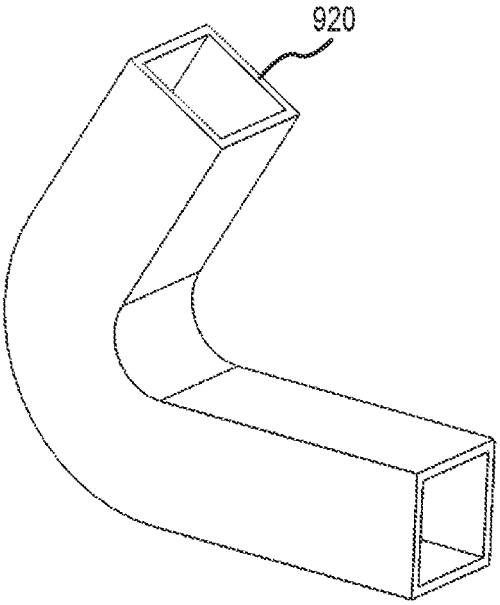
FIG. 9D illustrates a perspective view of a bent rod with a box profile for use with a snow or ice retention system, in accordance with various embodiments.
Figure 10A:
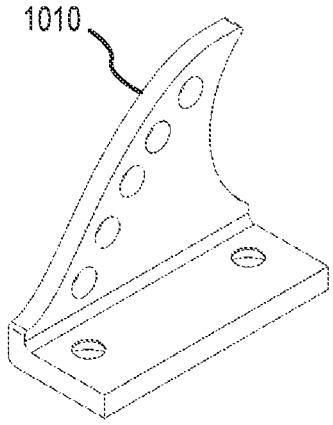
FIG. 10A illustrates a perspective view of bracket having a fin profile for use with a snow or ice retention system, in accordance with various embodiments.
Figure 10B:
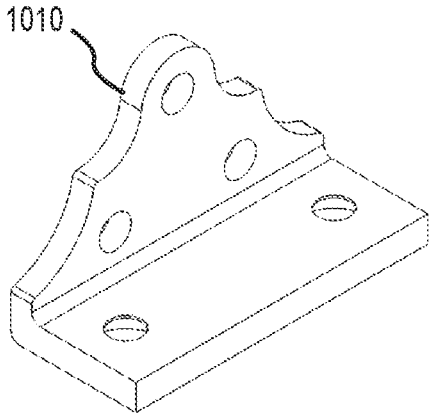
FIG. 10B illustrates a perspective view of bracket having a rounded steeple profile for use with a snow or ice retention system, in accordance with various embodiments.
Figure 10C:
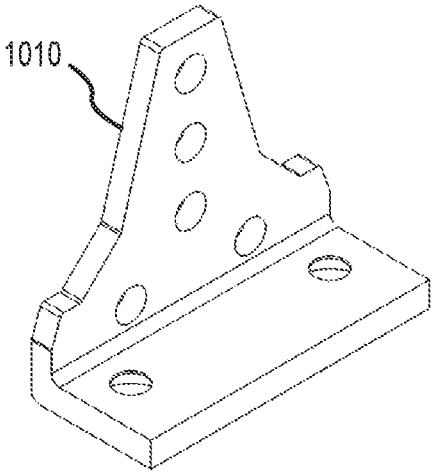
FIG. 10C illustrates a perspective view of bracket having a square steeple profile for use with a snow or ice retention system, in accordance with various embodiments.
Figure 10D:
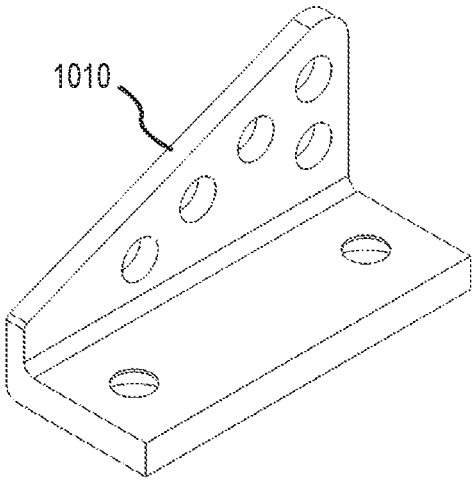
FIG. 10D illustrates a perspective view of bracket having a low wedge profile for use with a snow or ice retention system, in accordance with various embodiments.
Figure 10E:
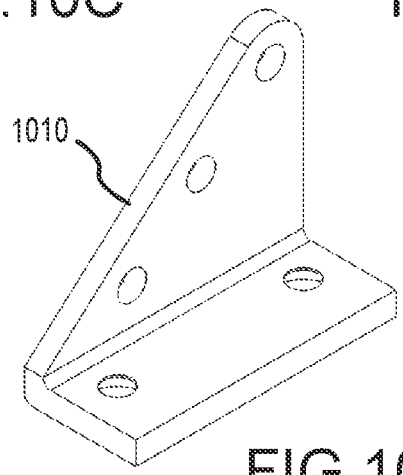
FIG. 10E illustrates a perspective view of bracket having a triangular profile for use with a snow or ice retention system, in accordance with various embodiments.
Figure 11A:
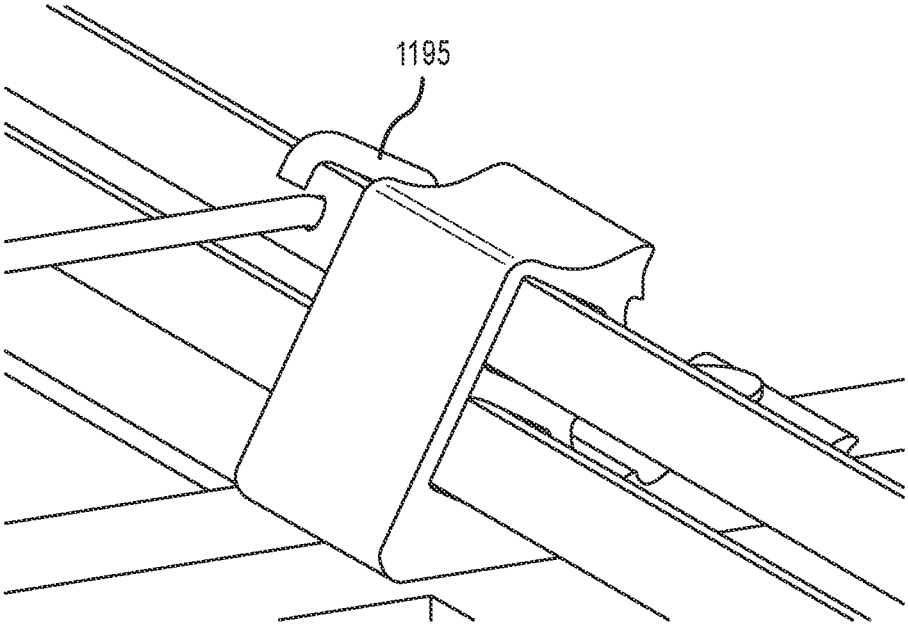
FIG. 11A illustrates a first perspective view of a snow or ice retention system including a first wrapped wire, in accordance with various embodiments.
Figure 11B:
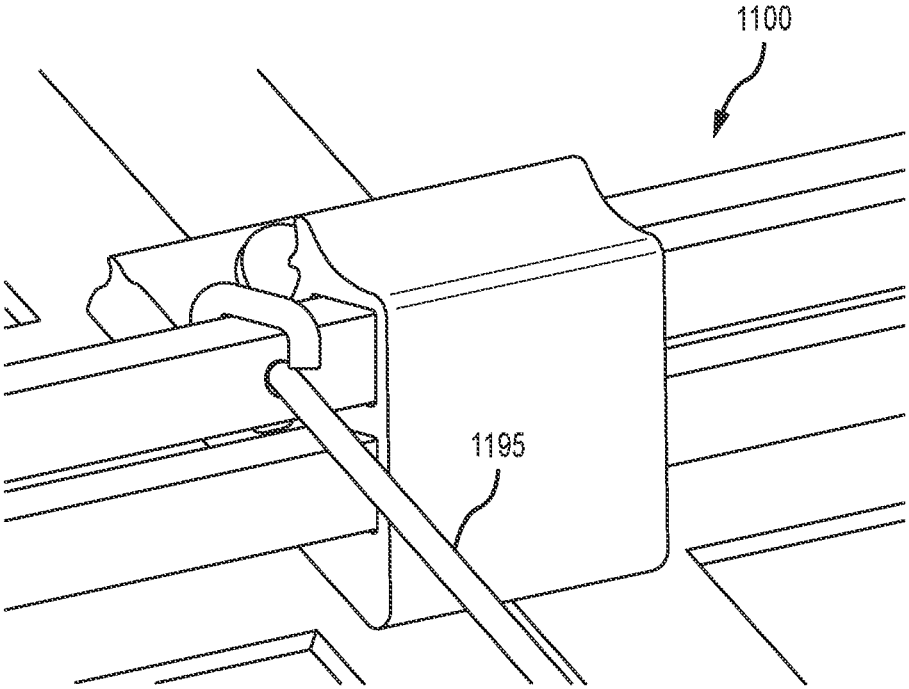
FIG. 11B illustrates a second perspective view of a snow or ice retention system including a first wrapped wire, in accordance with various embodiments.
Figure 11C:
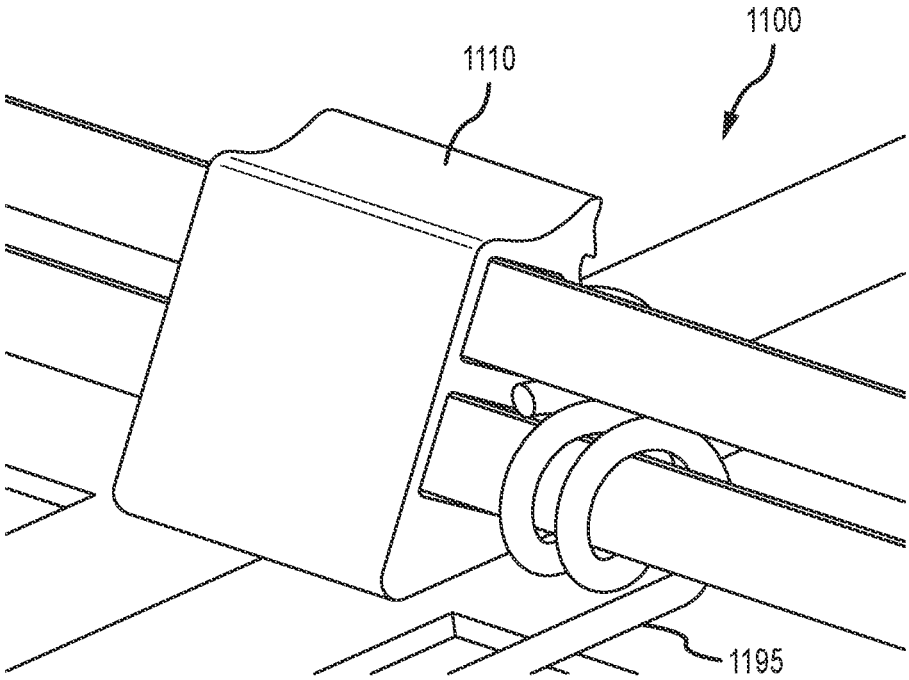
FIG. 11C illustrates a first perspective view of a snow or ice retention system including a second wrapped wire, in accordance with various embodiments.
Figure 11D:
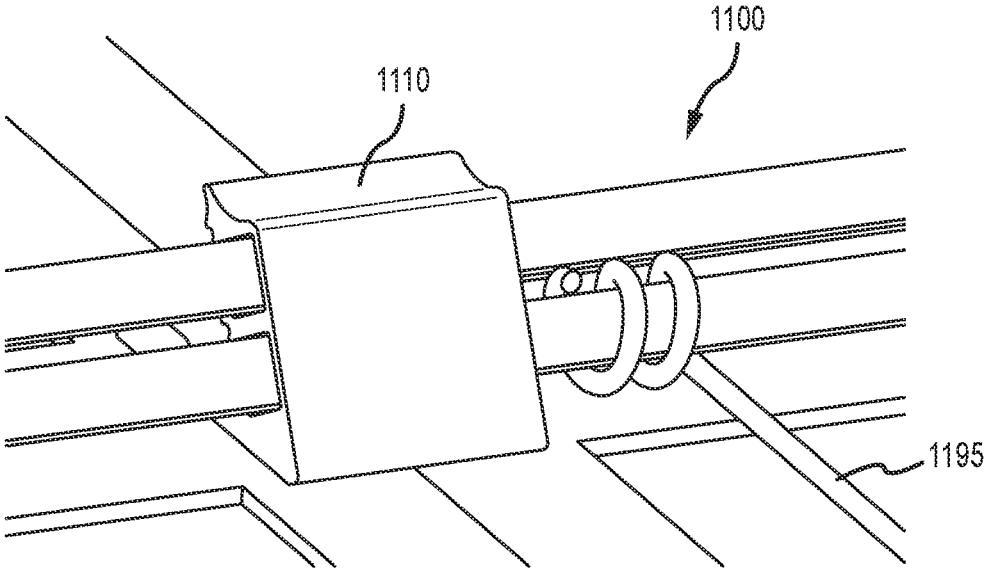
FIG. 11D illustrates a second perspective view of a snow or ice retention system including a second wrapped wire, in accordance with various embodiments.

In various embodiments and with reference to FIGS. 9A-9B, the ice retention system may be a mesh or screen 920. Mesh 920 may define a flow area. The flow area may correspond to an open area defined configured to allow ice or snow to move through the mesh. The ice retention system may be a plurality of wires 920.

In various embodiments and with reference to FIGS. 10A through 10E, the wire and bar systems may leverage various bracket structures in the retention structures described herein. In some embodiments and with specific reference to FIG. 10A, bracket 1010 may have a fin profile, one or more channels 1014 to receive the various bar and wire structures described herein, and one or more mounting apertures 14. In other embodiments and with specific reference to FIG. 10B, bracket 1010 may have a rounded steeple profile, one or more channels 1014 to receive the various bar and wire structures described herein, and one or more mounting apertures 14. In other embodiments and with specific reference to FIG. 10C, bracket 1010 may have a square steeple profile, one or more channels 1014 to receive the various bar and wire structures described herein, and one or more mounting apertures 14. In some embodiments and with specific reference to FIG. 10D, bracket 1010 may have a low wedge profile, one or more channels 1014 to receive the various bar and wire structures described herein, and one or more mounting apertures 14. In some embodiments and with specific reference to FIG. 10D, bracket 1010 may have a triangular profile, one or more channels 1014 to receive the various bar and wire structures described herein, and one or more mounting apertures 14.

In various embodiments and with reference to FIGS. 11A-11D, retention system 1100 may comprise a bracket 1110 and a bar system 1130 as described herein. Bar system 1130 and/or bracket 1110 may be adapted to receive a wire 1195. Wire 1195 may be installed on a bar 1132 of bar system 1130. More specifically, bar 1132 may comprise a through hole or aperture 1137. Wire 1195 may be adapted or configured to installably engage bar 1132 at through hole 1137. An end of wire 1195 may be wrapped around bar 1132 to create a hook 1197. Wire 1195 may also be wrapped about an outer surface of bar 1132 of bar system 1130. Wire 1195 may be a resistive heating wire that is configured to conduct energy and/or to one or more bar systems 1130 or bracket 1110 to facilitate removal of snow and/or ice from a building surface 20. Wire 1195 may also be configured to create additional structure and/or service area to facilitate the capture of snow and ice.

Figure 12A:
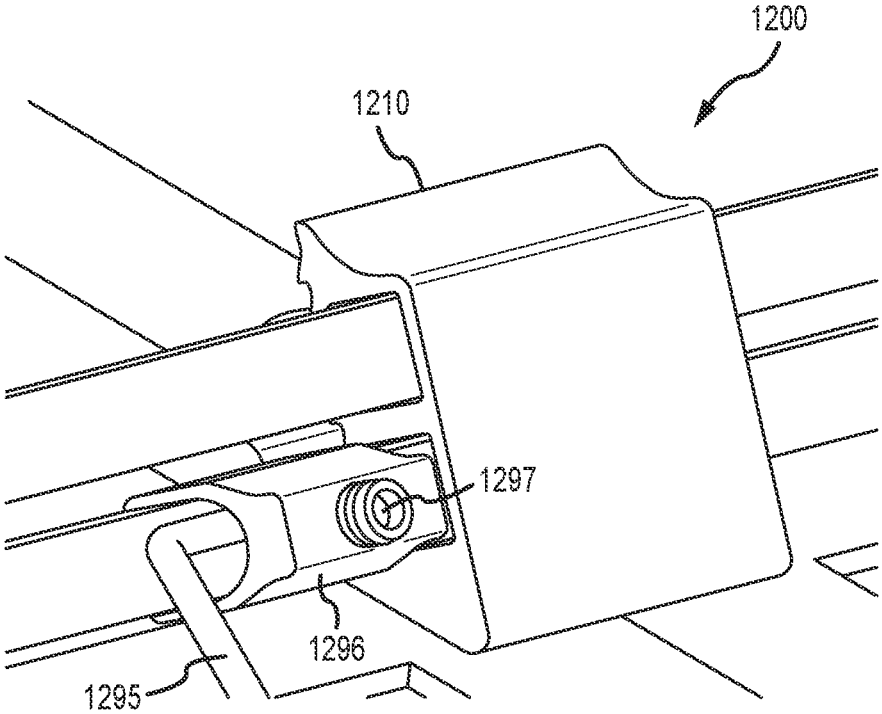
FIG. 12A illustrates a first perspective view of a snow or ice retention system including a wire and wire clip, in accordance with various embodiments.
Figure 12B:
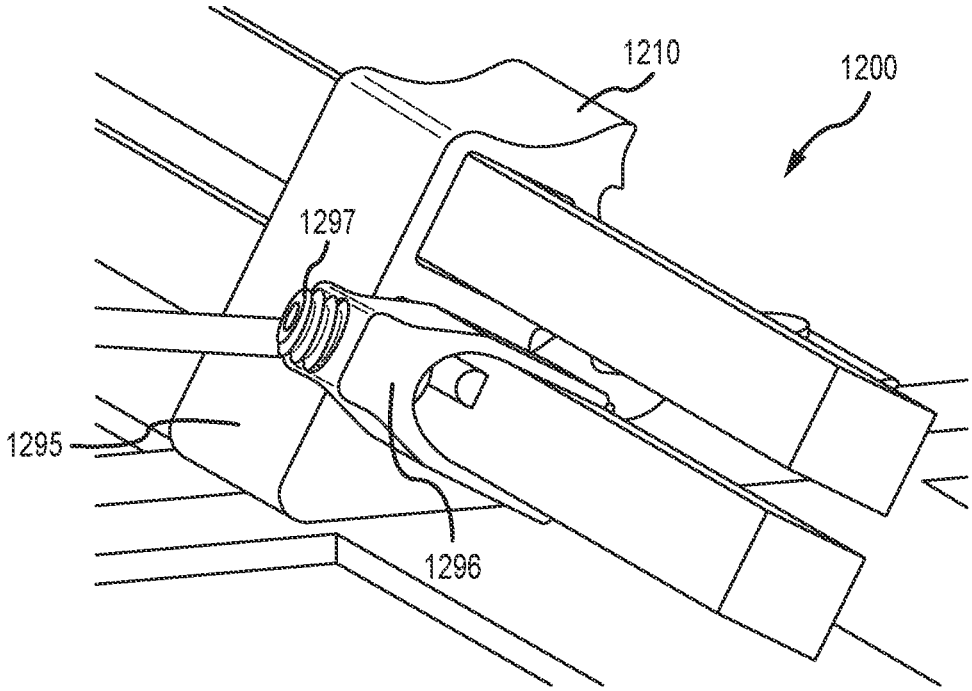
FIG. 12B illustrates a second perspective view of a snow or ice retention system including a wire and wire clip, in accordance with various embodiments.
Figure 12C:
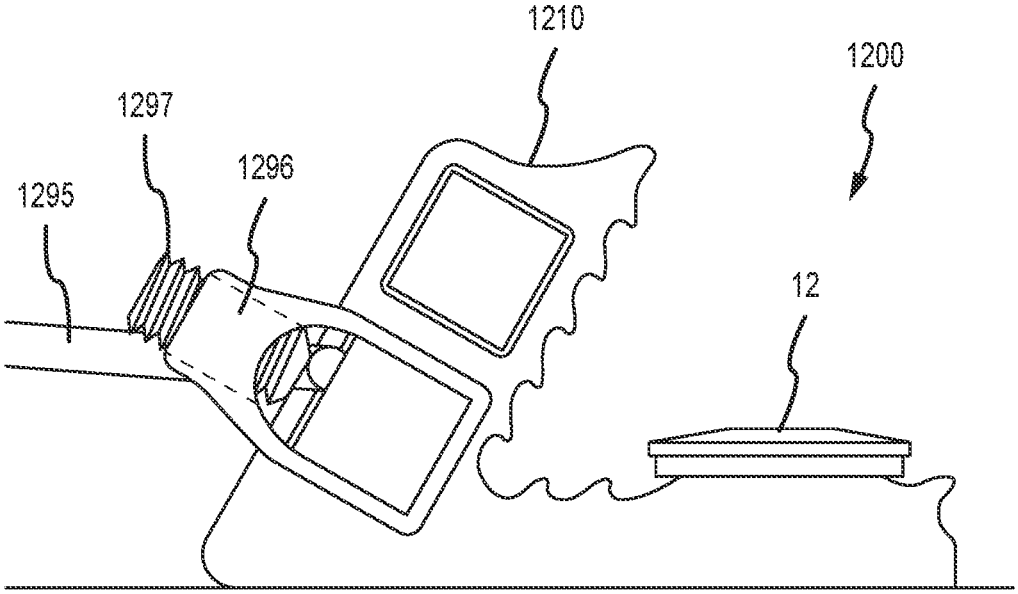
FIG. 12C illustrates a side view of a snow or ice retention system including a wire and wire clip, in accordance with various embodiments.

In various embodiments and with reference to FIGS. 12A-12C, retention system 1200 may comprise a bracket 1210 and a bar system 1230 as described herein. Bar system 1230 and/or bracket 1210 may be adapted to receive a wire 1295. Wire 1295 may be installed on a bar 1232 of bar system 1230 with an installation clip 1296. Installation clip 1296 may be configured to slidably engage bar 1232 and receive a portion of wire 1295. Moreover, installation clip 1296 may be configured with a set screw or fastener 1297 that is configured to threadably engage and pass through the body of installation clip 1296. In this regard, set screw 1297 may engage and compress wire 1295 in installation clip 1296 and against bar 1232. Wire 1295 may be a resistive heating wire that is configured to conduct energy and/or to one or more bar systems 1230 or bracket 1210 to facilitate removal of snow and/or ice from a building surface 20. Wire 1295 may also be configured to create additional structure and/or service area to facilitate the capture of snow and ice. Retention system 1200 may be mounted to building surface 20 with fasteners and a washer 12 as described herein.

Figure 13A:
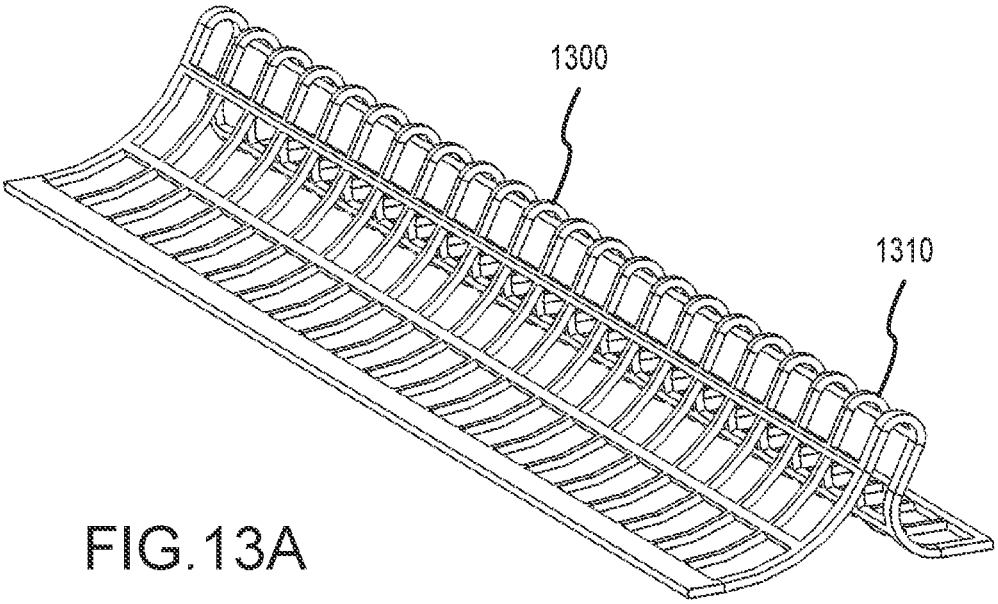
FIG. 13A illustrates a perspective view of a first snow or ice retention screen, in accordance with various embodiments.
Figure 13B:
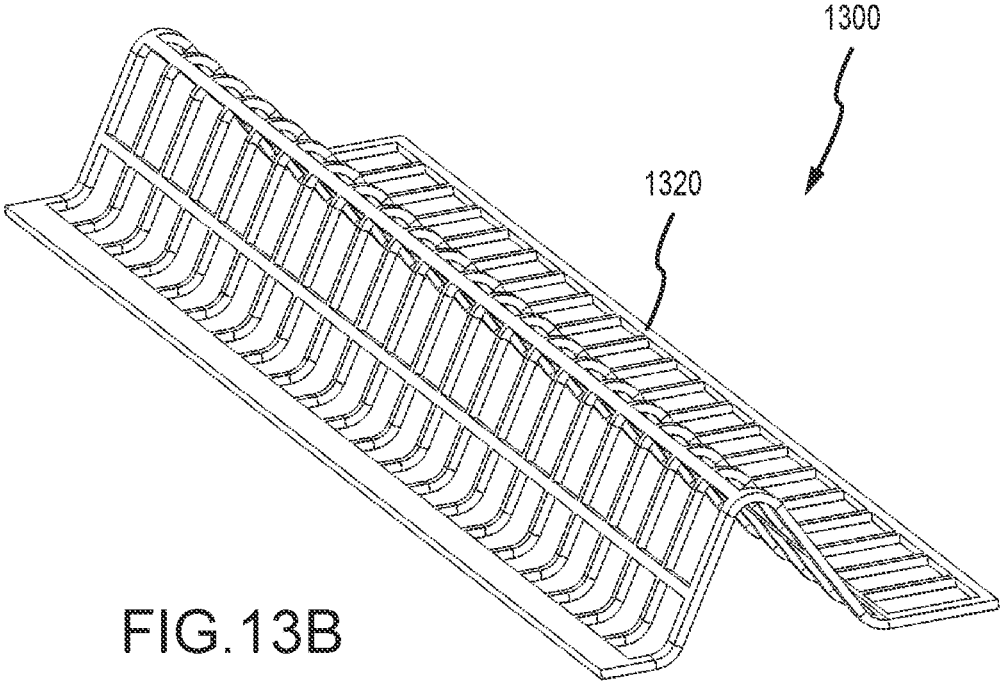
FIG. 13B illustrates a perspective view of a second snow or ice retention screen, in accordance with various embodiments.

In various embodiments and with reference to FIGS. 13A and 13B, retention system 1300 may include a screen 1310. Screen 1310 may comprise a plurality of members 1312 uniformly or non-uniformly spaced apart from each other and extending between a leading edge 1314 and a trailing edge 1316. The plurality of members 1312 may be substantially parallel to one another. Screen 1310 may also comprise one or more supports 1318. Support 1318 may be in for integrally formed or operatively coupled to the plurality of members 1312. Moreover, support 1318 may be disposed substantially perpendicular to the plurality of members 1312. One or more supports 1318 may be disposed equidistantly or non-equidistantly between the leading edge 1314 and trailing edge 1316 of screen 1310. Moreover, support 1318 may define and/or be disposed at leading edge 1314, trailing edge 1316, a crest 1319 of screen 1310, and/or at any other suitable position between leading edge 1314 and trailing edge 1316.

In various embodiments, the plurality of members 1312 may be shaped in a swept doom profile as shown in FIG. 13A. The plurality of members 1312 may also be shaped as in a gradual dome profile as shown in FIG. 13B. Moreover, one of skill in the art will appreciate after reading the present disclosure that the plurality of members may be shaped in any suitable fashion or profile to facilitate the management of snow and ice progression from a building surface.

Figure 14A:
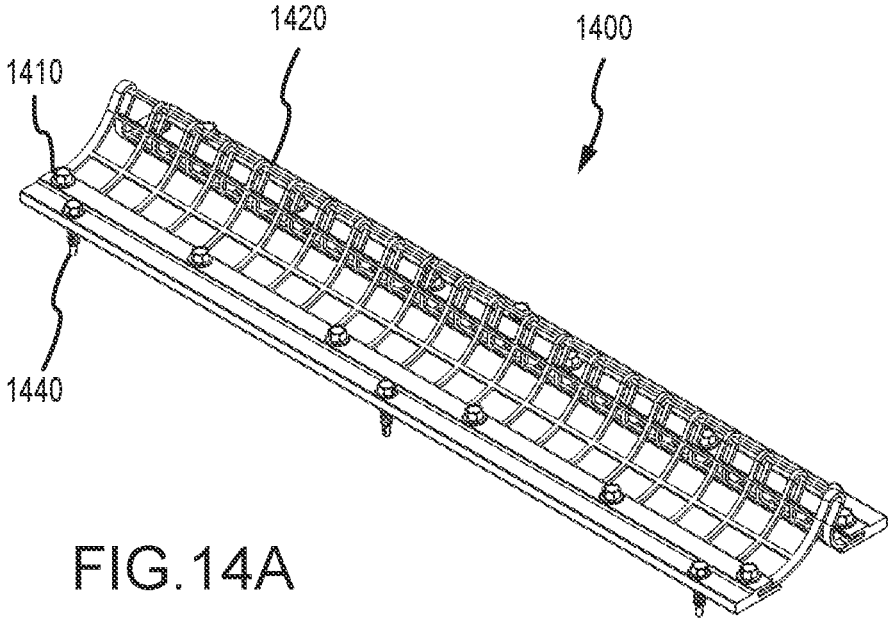
FIG. 14A illustrates a perspective view of a first snow or ice retention screen and fastening system, in accordance with various embodiments.
Figure 14B:
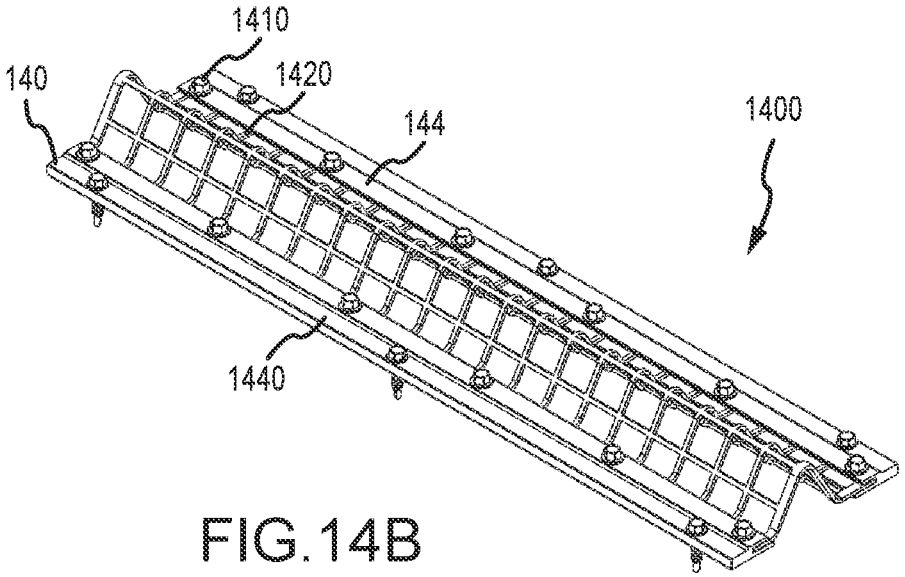
FIG. 14B illustrates a perspective view of a first snow or ice retention screen and fastening system, in accordance with various embodiments.

In various embodiments and with reference to FIGS. 14A and 14B, retention system 1400 may include a screen 1410 and an attachment system 1420. Screen 1410 may comprise a plurality of members 1412 disposed substantially parallel to one another between leading edge 1414 and trailing edge 1416, as discussed herein. Screen 1410 may also comprise one or more supports 1418 disposed substantially perpendicular to the plurality of members 1412. Supports 1418 may also be part of attachment system 1420. In this regard, supports 1418 may be configured to receive fasteners 1440 to attach screen 1410 to a building surface. Supports 1418 may include apertures for installation of fasteners. These apertures may be formed during manufacturing of the support or may be field formed.

Figure 15A:
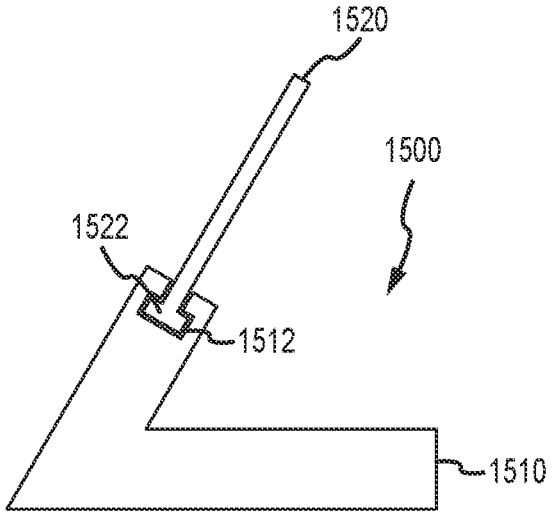
FIG. 15A illustrates a side view of a first bracket with a snow or ice retention portion, in accordance with various embodiments.
Figure 15B:
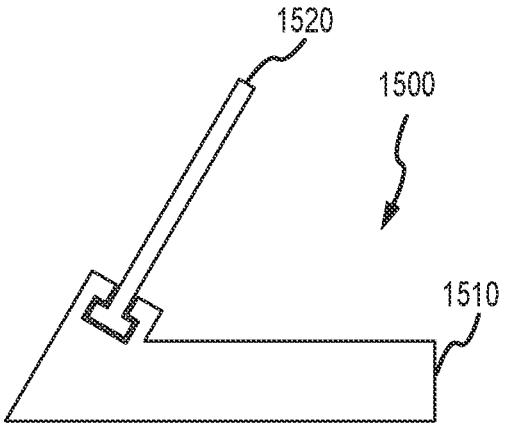
FIG. 15B illustrates a side view of a second bracket with a snow or ice retention portion, in accordance with various embodiments.

In various embodiments and with reference to FIGS. 15A and 15B, retention system 1500 may comprise a base 1510 and a barrier 1520. Barrier 1520 may be operatively installed in base 1510. To that end, base 1510 may comprise a channel or t-slot 1512. Barrier 1520 may be configured with a "T" end 1522. "T" end 1522 may be shaped such that it is receivable within channel 1512. "T" end 1522 may be slidably coupled to channel 1512.

After reading the present disclosure, one of ordinary skill in the art will appreciate that the mechanical structures described herein may be used interchangeably with one another to create solutions to manage ice and/or snow on building services.

Figure 16A:
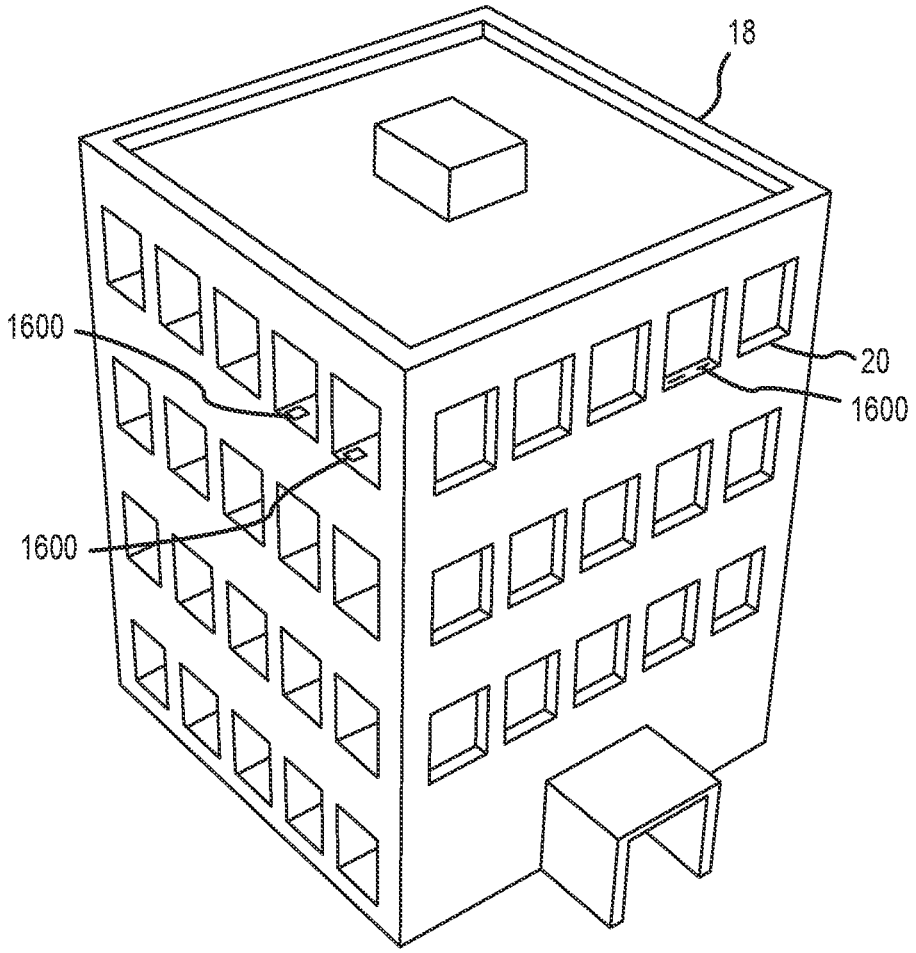
FIG. 16A illustrates a perspective view of a building that includes snow or ice retention systems, in accordance with various embodiments.
Figure 16B:
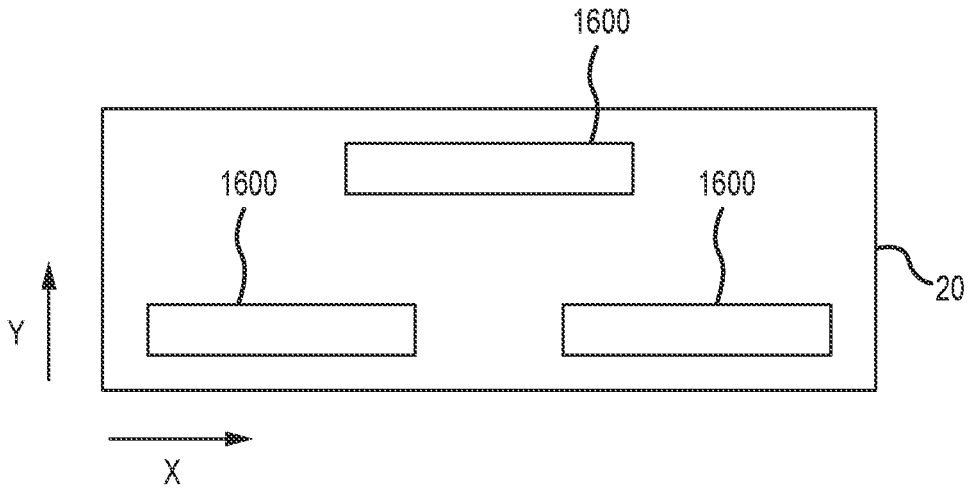
FIG. 16B illustrates a view of a building ledge or surface that includes snow or ice retention systems laid out in a staggered array, in accordance with various embodiments.
Figure 16C:
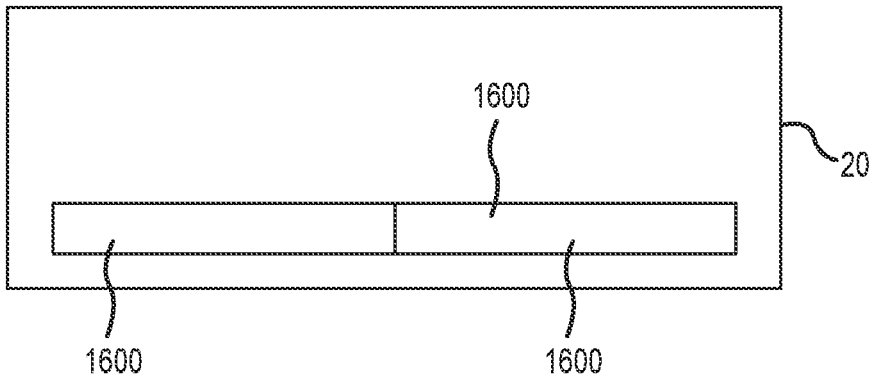
FIG. 16C illustrates a view of a building ledge or surface that includes snow or ice retention system laid out in a single line, in accordance with various embodiments.

In various embodiments and with reference to FIGS. 16A-16C, retention system 1600 may be installed on one or more building surfaces 20 of building 18. Retention system 1600 may be installed on any suitable building surface. More specifically, retention system 1600 may be installed on any building that may require management of accumulated snow and ice.

In some embodiments and with particular reference to FIG. 16B, retentions system 1600 may be installed in a staggered array on building surface 20. In this regard, a first retention system 1600 and a second retentions system 1600 may be installed in a substantially linear but spaced apart from one another along an X-axis. A third retention system 1600 may be spaced apart from first retention system 1600 and second retention system 1600, but may provide coverage of the gap between first retention system 1600 and second retention system 1600.

In other embodiments and with particular reference to FIG. 16C, retentions system 1600 may be installed in a linear arrangement on building surface 20. In this regard, first retention system may be manufactured, or field formed (e.g., cut) to a specific length to accommodate the geometry to building surface 20. First retention system 1600 and second retention system 1600 may also be installed in a linear fashion adjacent to one another such that there is no gap, a negligible gap, or a small gap between first retention system 1600 and second retention system 1600. Moreover, first retention system 1600 and second retention system 1600 may be spliced together for added strength, to facilitate installation, and the like.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A retention system, comprising:

a bracket having a first portion and a second portion, the first portion defining a channel, the first portion and the second portion being operatively coupled together at an angle θ, the bracket having a texture on a first upslope surface of the first portion and a second upslope surface of the second portion, the first portion having a planar side opposite the first upslope surface, and the bracket defining a mounting surface in the second portion;

a weep hole defined through the bracket and configured to move moisture through a front surface of the bracket;

a bar system comprising a bar installable in the bracket and surrounded by the channel;

a seal installable in the bracket and disposed beneath the mounting surface; and a bonded washer installable on and compressible against the mounting surface.

2. The retention system of claim 1, wherein the bar system is removable from the bracket.

3. The retention system of claim 1, wherein the bar system is integrally formed with the bracket.

4. The retention system of claim 1, further comprising a wire coupled to the bar system.

5. The retention system of claim 1, wherein the texture is one of a saw tooth profile, a barbell profile, a t-standoff profile, a straight standoff profile, a L-stand-off profile, or serrations.

6. The retention system of claim 1, wherein the bar system has a surface texture.

7. The retention system of claim 1, wherein the bar has a one of a sideways v profile, a hub and spoke profile, a c channel profile, a triangular shaped profile, an I-beam profile, a plus sign profile, a box profile, or a pipe profile.

8. The retention system of claim 1, wherein the bar system has a uniform geometric profile.

9. The retention system of claim 1, wherein 0 is between 35° and 65°.

10. The retention system of claim 1, wherein 0 is between 35° and 55°.

11. The retention system of claim 1, wherein 0 is between 40° and 50°.

12. The retention system of claim 1, wherein 0 is approximately 45°.

* * * * *